US005796420A

United States Patent [19]

Kaerts et al.

[11] Patent Number: 5,796,420

[45] Date of Patent: Aug. 18, 1998

[54] METHOD FOR CORRECTING ACROSS-THE-HEAD UNEVENESS IN A THERMAL PRINTING SYSTEM

[75] Inventors: Eric Kaerts, Melsele; Paul Verzele, Beveren, both of Belgium

[73] Assignee: AGFA-Gevaert, Mortsel, Belgium

[21] Appl. No.: 248,336

[22] Filed: May 24, 1994

[30] Foreign Application Priority Data

May 28, 1993 [EP] European Pat. Off. ..... 93201534

[51] Int. Cl.[6] ..... B41J 2/36; B41J 2/37; B41J 2/365

[52] U.S. Cl. ..... 347/188; 347/191

[58] Field of Search ..... 347/188, 191, 347/237, 183; 400/120.09, 120.11; 358/298

[56] References Cited

U.S. PATENT DOCUMENTS

| | | | |
|---|---|---|---|
| 4,801,948 | 1/1989 | Kato | 346/76 |
| 4,827,279 | 5/1989 | Lubinsky et al. | 346/76 |
| 4,918,462 | 4/1990 | Tomita et al. | 347/237 |
| 5,160,941 | 11/1992 | Fujiwara et al. | 346/76 |

FOREIGN PATENT DOCUMENTS

| | | |
|---|---|---|
| 0375073 | 12/1989 | European Pat. Off. . |
| 0375921-A | 11/1889 | Japan . |
| 62-56161 | 3/1987 | Japan . |
| 1192561 | 8/1989 | Japan . |
| 1310971 | 12/1989 | Japan . |
| 9114577 | 10/1991 | United Kingdom . |

OTHER PUBLICATIONS

Sasaki et al High Quality Recording in Thermal Dye Transfer Printing– 478–484 Nov. 89.

*Primary Examiner*—Benjamin R. Fuller
*Assistant Examiner*—L. Anderson
*Attorney, Agent, or Firm*—Richard J. Birch

[57] ABSTRACT

A method for printing by thermal sublimation is provided, comprising the steps of: 1) supplying uncorrected input data $I_{i,u}$ to a processing unit of a printer having a head with a plurality of heating elements; 2) obtaining density correction means $M_{i,d}$ for improving across-the-head uneveness according to the steps of: a) activating each heating element with power compensated input data, so that a same time-averaged power is generated in each heating element; b) measuring the printing density of pixels; c) estimating for each heating element the deviation $\delta_i$ of the density from a density aimed at by applying said power; d) calculating for each heating element a density correction means $M_{i,d}$ taking into account said deviation $\delta_i$; e) storing each of said density correction means $M_{i,d}$; 3) combining the respective uncorrected input data $I_{i,u}$ with the respective density correction means $M_{i,d}$; 4) providing the thus corrected data to the thermal head.

18 Claims, 18 Drawing Sheets

Image signal matrix I(i,j)

METHOD FOR CORRECTING ACROSS-THE-HEAD UNEVENESS IN A THERMAL PRINTING SYSTEM

FIELD OF THE INVENTION

The present invention relates to thermal dye diffusion printing, further commonly referred to as sublimation printing, and more particularly to a method for correcting across-the-head uneveness in the printing density of a thermal sublimation print.

BACKGROUND OF THE INVENTION

Thermal sublimation printing uses a dye transfer process, in which a carrier containing a dye is disposed between a receiver, such as a transparent or a paper, and a print head formed of a plurality of individual heat producing elements which will be referred to as heating elements. The receiver is mounted on a rotatable drum. The carrier and the receiver are generally moved relative to the print head which is fixed. When a particular heating element is energised, it is heated and causes dye to transfer, e.g. by diffusion or sublimation, from the carrier to an image pixel (or "picture element") in the receiver. The density of the printed dye is a function of the temperature of the heating element and the time the carrier is heated. In other words, the heat delivered from the heating element to the carrier causes dye to transfer to the receiver to make thereon an image related to the amount of heat. Thermal dye transfer printer apparatus offer the advantage of true "continuous tone" dye density transfer. By varying the heat applied by each heating element to the carrier, a variable density image pixel is formed in the receiver. However, in systems utilising this type of thermal print head it is often observed that the printing density is not uniform across the page, but that lines, streaks, and bands are visible.

U.S. Pat. No. 4,827,279 discloses a method for correcting the uneveness in the printed image. According to this method, first a flat field is printed using equal input data on a transparent receiver, then a microdensitometer measures the transmittance values of the receiver, then the digitised values are stored and finally these are used to adjust the number of heating pulses that are supplied to the heating elements.

This method however still leaves some disturbing banding in the printed image which will be perceived by the human eye, in particular as the image is recorded on a transparent receiver. Moreover, if the image is intended to be used in medical diagnostics, any banding is of special disturbance, because medical diagnosis executed by the radiologist is intrinsically based upon visual inspection of a radiographic image recorded on such a transparent film.

OBJECTS OF THE INVENTION

It is therefor an object of the present invention to provide in thermal sublimation printing an improved method for correcting the uneveness in the printing density across the headwidth, which gives a very effective eveness in the image and allows the image to be used in medical diagnostics.

Further objects and advantages will become apparent from the description given hereinbelow.

SUMMARY OF THE INVENTION

We now have found that the above object can be achieved by providing a method for printing an image by thermal sublimation, comprising the steps of:

1) supplying a stream of uncorrected input data $I_{i,u}$ to a processing unit of a thermal printer having a line type thermal head with a plurality of heating elements $H_i$;
2) obtaining density correction means $M_{i,d}$ for improving across-the-head uneveness in the printing density according to the steps of:
   a) activating each heating element with image input data, further indicated as "power compensated input data" i,p ,so that a same time-averaged power is generated in each heating element to obtain a flat field print;
   b) measuring in said flat field print the realized printing density of pixels (or "picture elements) corresponding to heating elements;
   c) estimating for each heating element the deviation ($\delta_i$) of the printing density from a printing density aimed at by said power applied to each heating element;
   d) calculating for each heating element a density correction means $M_{i,d}$ taking into account said deviation ($\delta_i$) in printing density; and
   e) storing each of said density correction means $M_{i,d}$ individually to each heating element into a memory means;
3) combining for each heating element the respective uncorrected input data $I_{i,u}$ with the respective density correction means $M_{i,d}$;
4) providing the thus corrected data $I_{i,c}$ to the thermal head for reproducing the image.

Further preferred embodiments of the present invention are set forth in the detailed description given hereinafter.

DETAILED DESCRIPTION OF THE INVENTION

Hereinbelow the present invention will be clarified in detail with reference to the attached drawings, without the intention to limit the invention thereto.

Figure 1:
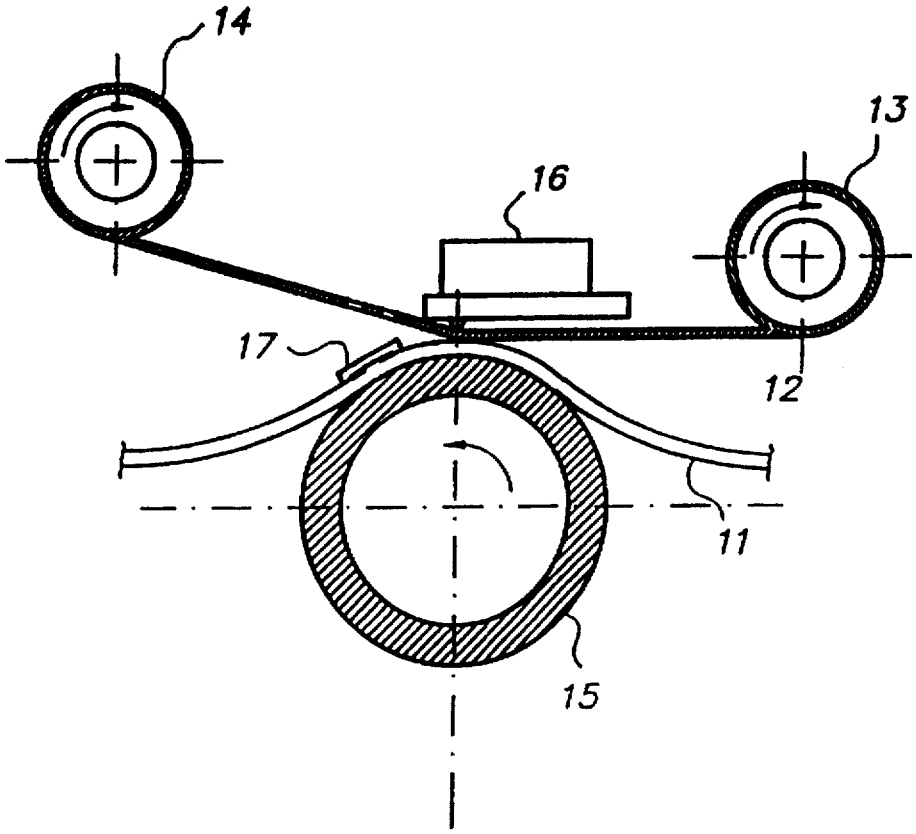
FIG. 1 is a principe scheme of a thermal sublimation printer.

Referring to FIG. 1, there is shown a global principle scheme of a thermal printing apparatus that can be used in accordance with the present invention and which is capable to print a line of pixels at a time on a receiver or acceptor member 11 from dyes transferred from a carrier or dye donor member 12. The receiver 11 is in the form of a sheet; the carrier 12 is in the form of a web and is driven from a supply roller 13 onto a take up roller 14. The receiver 11 is secured to a rotatable drum or platen 15, driven by a drive mechanism (not shown for purpose of simplicity) which continuously advances the drum 15 and the receiver sheet 11 past a stationary thermal head 16. This head 16 presses the carrier 12 against the receiver 11 and receives the output of the driver circuits. The thermal head 16 normally includes a plurality of heating elements equal in number to the number of pixels in the image data present in a line memory. The imagewise heating of the dye donor element is performed on a line by line basis, with the heating resistors geometrically juxtaposed each along another and with gradual construction of the output density. Each of these resistors is capable of being energized by heating pulses, the energy of which is controlled in accordance with the required density of the corresponding picture element. As the image input data have a higher value, the output energy increases and so the optical density of the hardcopy image 17 on the receiving sheet. On the contrary, lower density image data cause the heating energy to be decreased, giving a lighter picture 17.

Figure 2:
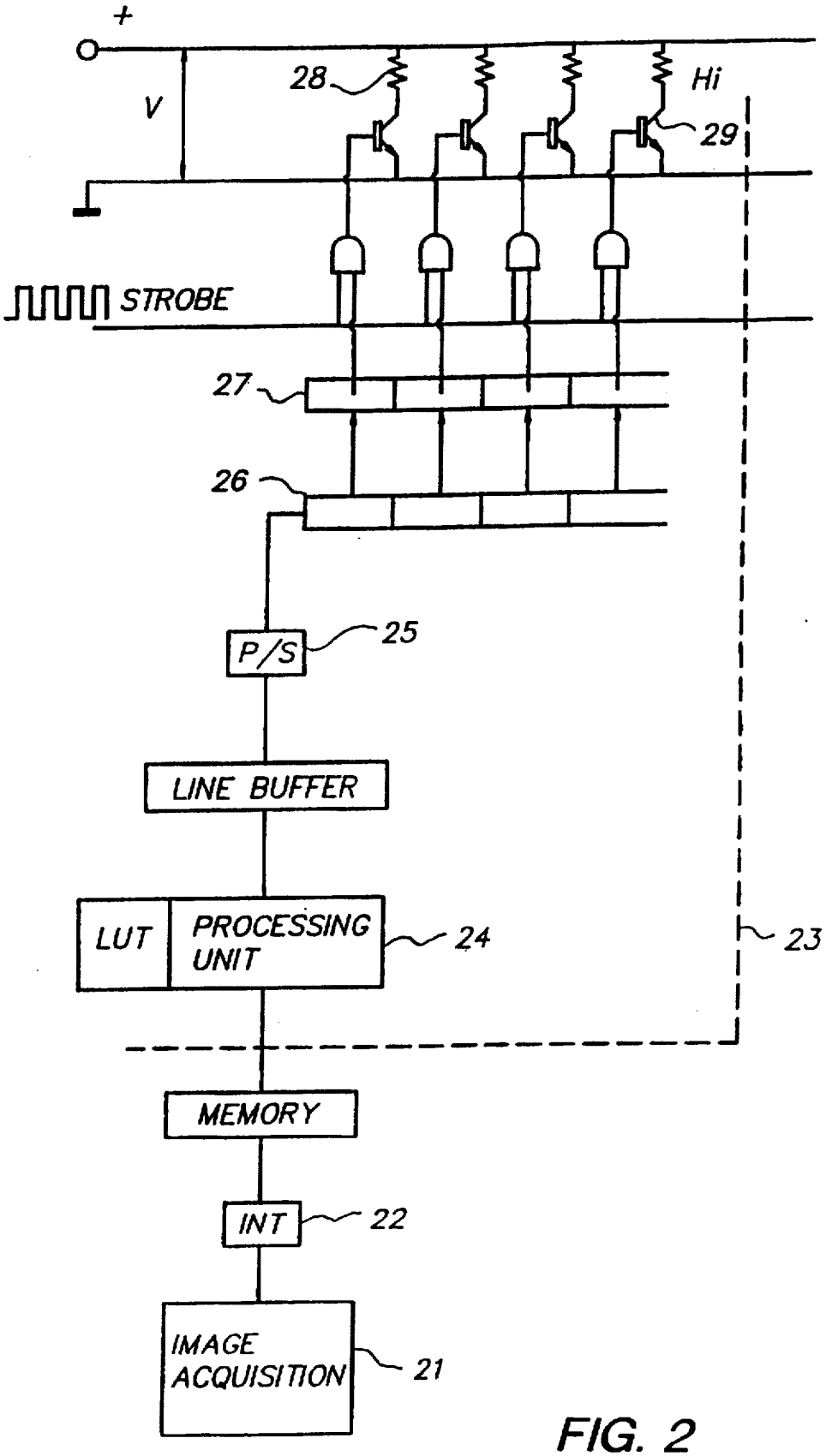
FIG. 2 is a data flow diagram of a thermal sublimation printer.
Figure 3:
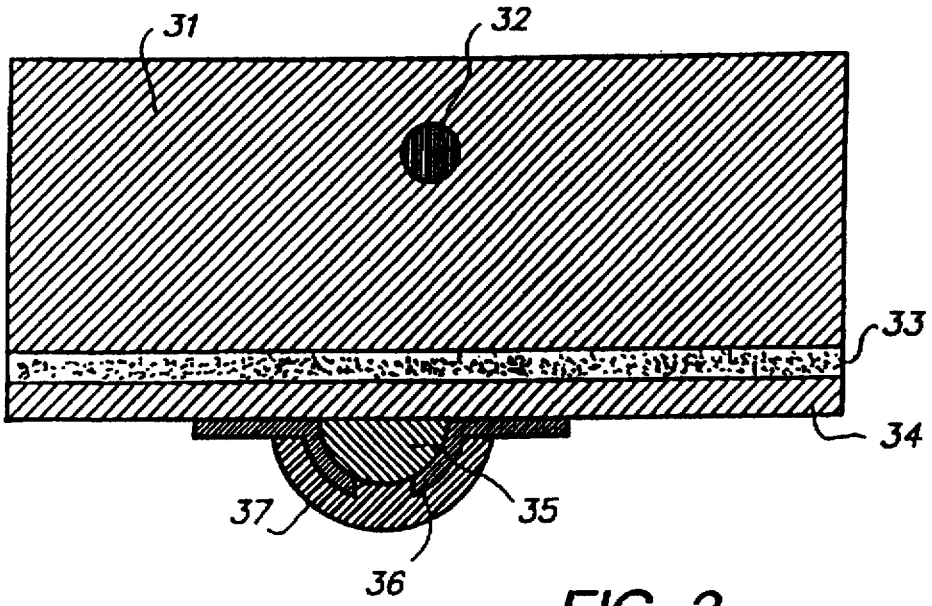
FIG. 3 is a crosssection of a thermal head.

FIG. 3 is a detailed crosssection of a thermal head, indicated as part 16 in FIG. 1 and containing a heatsink 31, a temperature sensor 32, a bonding layer 33, a ceramic substrate 34, a glazen bulb 35, a heating element (36 in FIG. 3, being equivalent to 28 in FIG. 2) and a wear-resistant layer 37.

In the present invention, the activation of the heating elements is preferably executed pulsewise and preferably by digital electronics. The different processing steps up to the activation of said heating elements are illustrated in the diagram of FIG. 2. First a digital signal representation is obtained in an image acquisition apparatus 21. Then, the image signal is applied via a digital interface 22 and a first storing means (indicated as MEMORY in FIG. 2) to a recording unit 23, namely a thermal sublimation printer. In the recording unit 23 the digital image signal is processed 24, which is explained more thoroughly in the next paragraph. Next the recording head (16 in FIG. 1) is controlled so as to produce in each pixel the density value corresponding with the processed digital image signal value 24. After processing (in 24) and parallel to serial conversion (in 25) of the digital image signals, a stream of serial data of bits is shifted into another storing means, e.g. a shift register 26, representing the next line of data that is to be printed. Thereafter, under controlled conditions, these bits are supplied in parallel to the associated inputs of a latch register 27. Once the bits of data from the shift register 26 are stored in the latch register 27, another line of bits can be sequentially clocked into said shift register 26. As to the heating elements 28, the upper terminals are connected to a positive voltage source (indicated as V in FIG. 2), while the lower terminals of the elements are respectively connected to the collectors of the driver transistors 29, whose emitters are grounded. These transistors 29 are selectively turned on by a high state signal (indicated as an "ANDed" STROBE in FIG. 2) applied to their bases and allow current to flow through their associated heating elements 28. In this way a thermal sublimation hardcopy (17 in FIG. 1) of the electrical image data is recorded.

Figure 4:
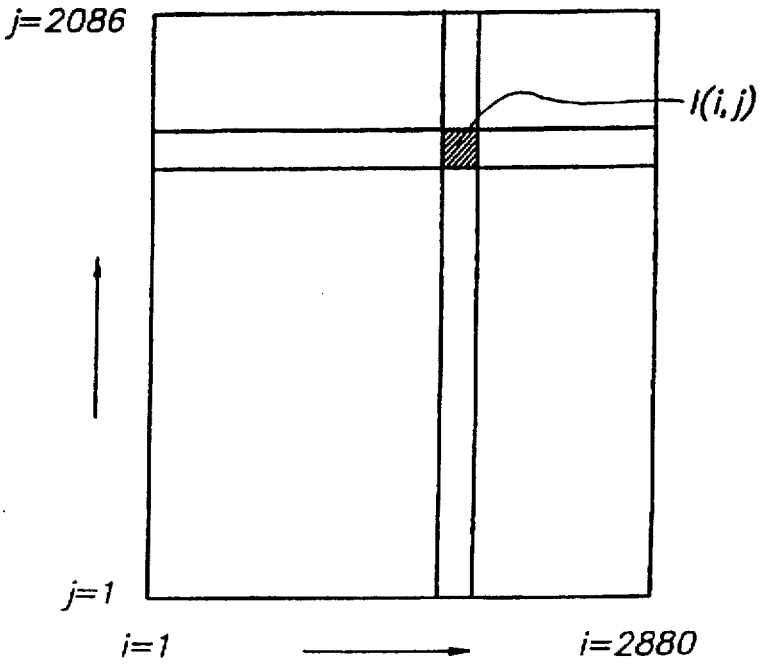
FIG. 4 is an image signal matrix representing quantised density values or image data.

Because the processing unit 24 is very important for the further disclosure of the present invention, special attention is now focused on it. As already mentioned before, the electrical image data are available at the input of 24. Said data are generally provided as binary pixel values, which are in proportion to the densities of the corresponding pixels in the original image. For a good understanding of said proportion, it is noted that an image signal matrix (see FIG. 4) is a twodimensional array of quantized density values or image data I(i,j) where i represents the pixel column location and j represents the pixel row location, or otherwise with i denoting the position across the head of the particular heating element and j denoting the line of the image to be printed. For example, an image with a 2880×2086 matrix will have 2880 columns and 2086 rows, thus 2880 pixels horizontally and 2086 pixels vertically. The content of said matrix is a number representing the density to be printed in each pixel, whereby the number of density values of each pixel to be reproduced is restricted by the number of bits pro pixel. For a K bit deep image matrix, individual pixels can have $N=2^K$ density values, ranging from 0 to $2^K-1$. If the matrix depth or pixel depth is 8 bits, the image can have up to $2^8$ or 256 density values.

More in particular, the image signal matrix to be printed is preferably directed to an electronic lookup table (abbreviated as LUT) which correlates the density to the number of pulses to be used to drive each heating element ($H_i$) in the thermal print head; this number will further be referred to as input data ($I_i$). These pulses may be corrected by correlating each of the strings of pulses to density correcting methods. The corrected pulses are then directed to the head driver for energizing the thermal heating elements within the thermal head.

Figure 5:
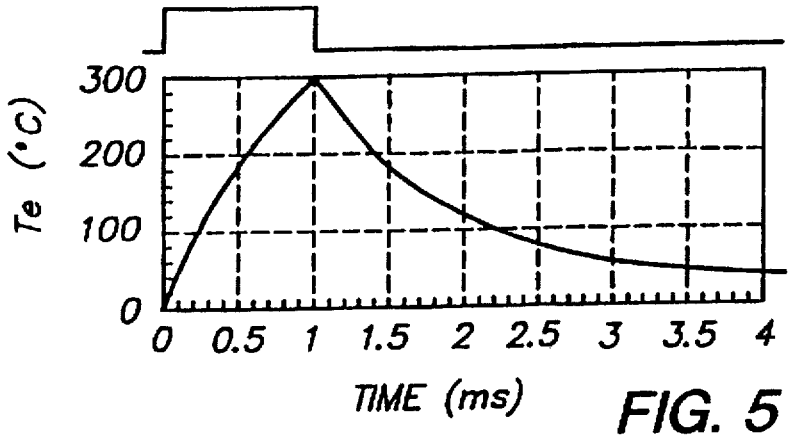
FIG. 5 is a graph of the heating and cooling curve of a heating element resulting from one single heating pulse.

Before the invention is described in further detail, it is useful to illustrate (FIG. 5) the effect of feeding one activation pulse to a resistive heating element 28, showing the temperature on the vertical axis and the time on the horizontal axis. During said activation pulse the temperature of the resistive heating element, indicated as $T_e$, rises from e.g. 20° C. to 300° C., rising steeply at first and then more gradually. After the activation has been switched off, the resistive heating element cools at an even more gradual rate.

Figure 6:
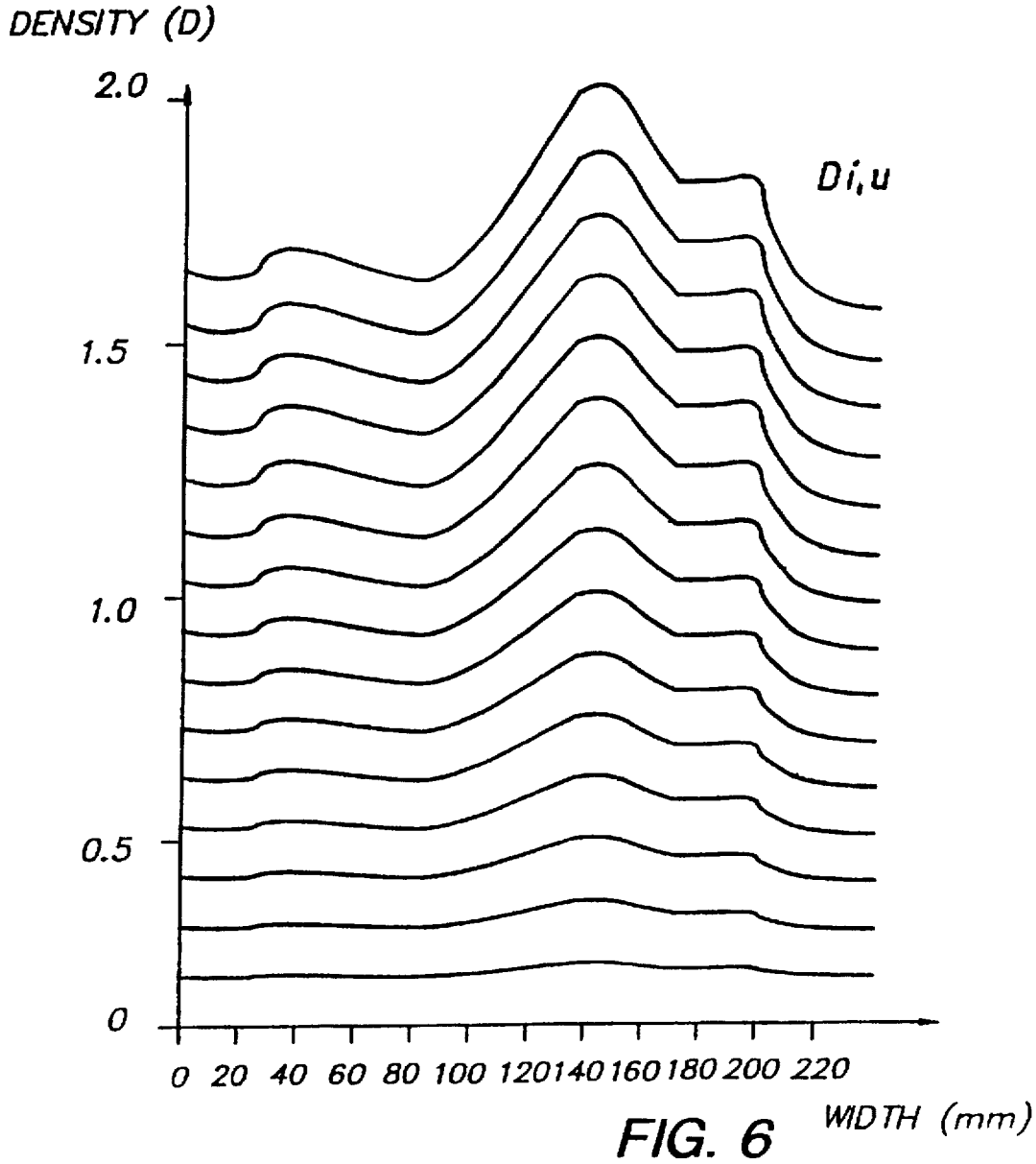
FIG. 6 is a chart illustrating the variance in printing density across a flat field print corresponding to successive amounts of heating relating to successive values of uncorrected image input data signals.

In systems utilising this type of thermal print head it is often observed that the printing density is not uniform across the page, but that lines, streaks, and bands are visible in the direction parallel to the page motion. This uneveness occurs even when the input to the thermal head represents a socalled "flat field", meaning that the inputs are identical, and thus that all of the heating elements are heating in response to the same constant input. Said variance in optical density from one position to another across the width of a print head, for an exemplary flat field, is graphically illustrated by FIG. 6. Even for similarly constructed heating elements contained within one thermal head, there might be an initial variance between the density output created by one heating element versus the density output created by another heating element with both of the heating elements receiving pulses of equal type and equal number at the same time. Further, it is often observed that the size of the density uneveness varies with the lifetime of the thermal head and with the amount of heating. FIG. 6 illustrates how the printing density varies across the width of the printhead, and how this variation becomes more pronounced at higher density levels relating to higher amounts of heating.

Regarding said density uneveness, this may be eliminated by the method of the present invention, which now will be shortly summarized by its essential features. According to said method, the activating of the heating elements is preceded by retrieving, from the initial configuration settings stored in a memory means (abbreviated as MEM_0) in the printer, a predetermined power value (further represented by $P_{ref}$) and by adjusting the power of the heating element actually producing the lowest time averaged power (further represented by $P_{min}$) to said predetermined power value.

According to same said method of the present invention, said adjusting of the maximum power available for each heating element ($P_{i,u}$) to said predetermined power value ($P_{ref}$) is followed by equalising the printing power of all heating elements to a same time averaged power value, preferably equal to $P_{ref}$.

By the method of the present invention, an improved eveness in the printing image is attained, which is remarkably better than the state of the art (as e.g. described in U.S. Pat. No. 4,827,279 and in WO-A- 91 14577). The main reason for the attained eveness may be given by the fact that in the present invention only strongly reduced lateral heat-flows between neighbouring heating elements exist, because all heating elements are activated with exactly the same time averaged electrical power and so they all have the same temperature.

Whereas U.S. Pat. No. 4,827,279 energizes the heating elements with equal data inputs and thus equal number of pulses, the corresponding powers generated in the heating elements will be inevitably be confounded by the differences inherent to each thermal head (as e.g. variations in the resistance of different heating elements, ref. 28 in FIG. 2, variations in the delaytimes of the switching circuits, ref. 29; variations in the mechanical contact between the thermal head and the dye layer, refs. 16 and 11 in FIG. 1; variations in the thermal contact between the ceramic substrate of the head assembly and the heatsink, refs. 34 and 31 in FIG. 3; etc.), resulting in unequal power dissipations and thus causing the above mentioned unequal densities.

Whereas WO-A-91 14577 energizes the heating elements with input data using gradation correction data derived from measurements of the optical data of spots recorded in response to uncorrected input data, also here the corresponding powers generated in the heating elements will inevitably be confounded by the differences inherent to each thermal head, resulting in unequal power dissipations and thus causing the above mentioned unequal densities.

Figure 17A:
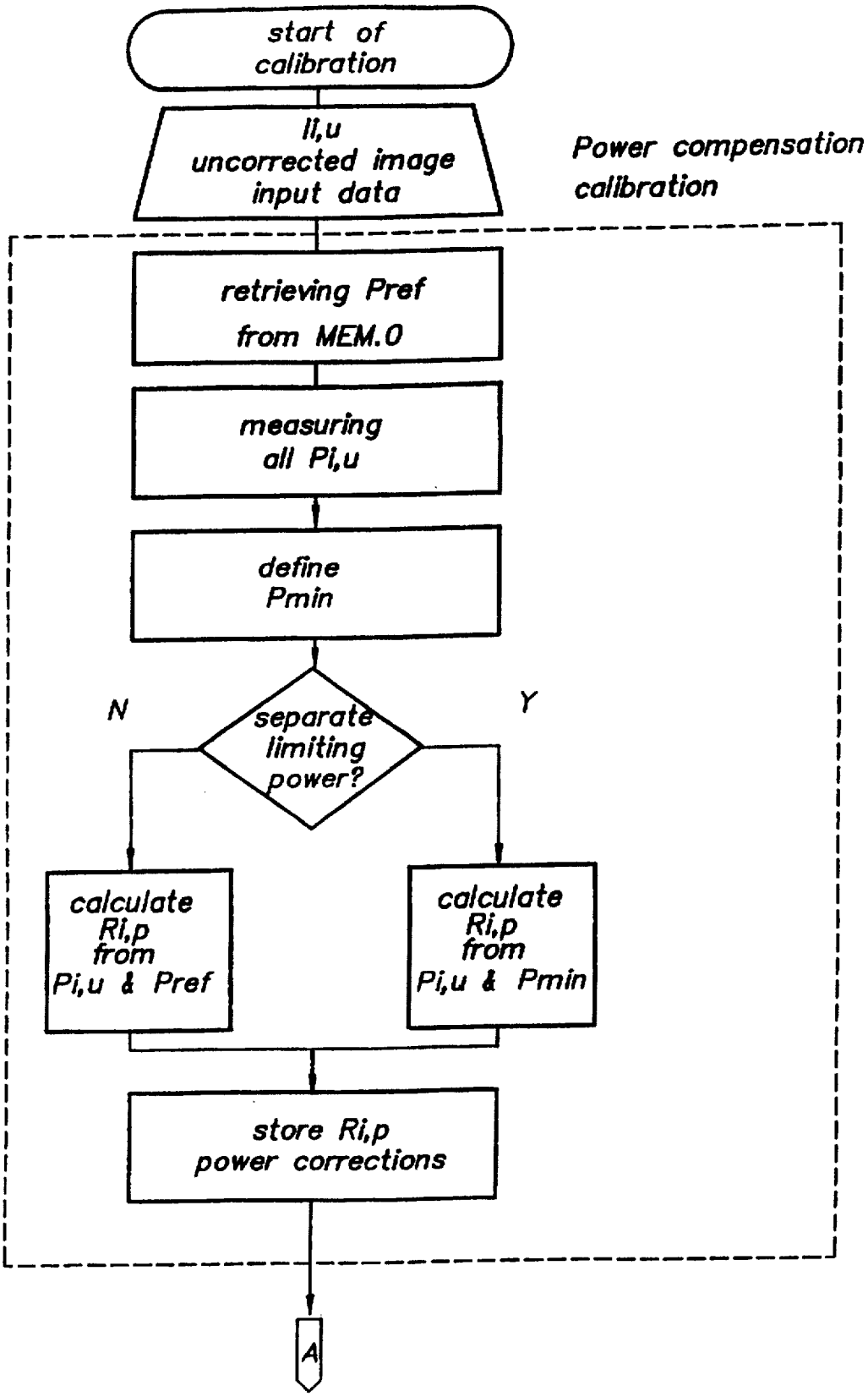
FIG. 17 is a flowchart illustrating all main steps of the method of the present invention according to a preferred embodiment.
Figure 17B:
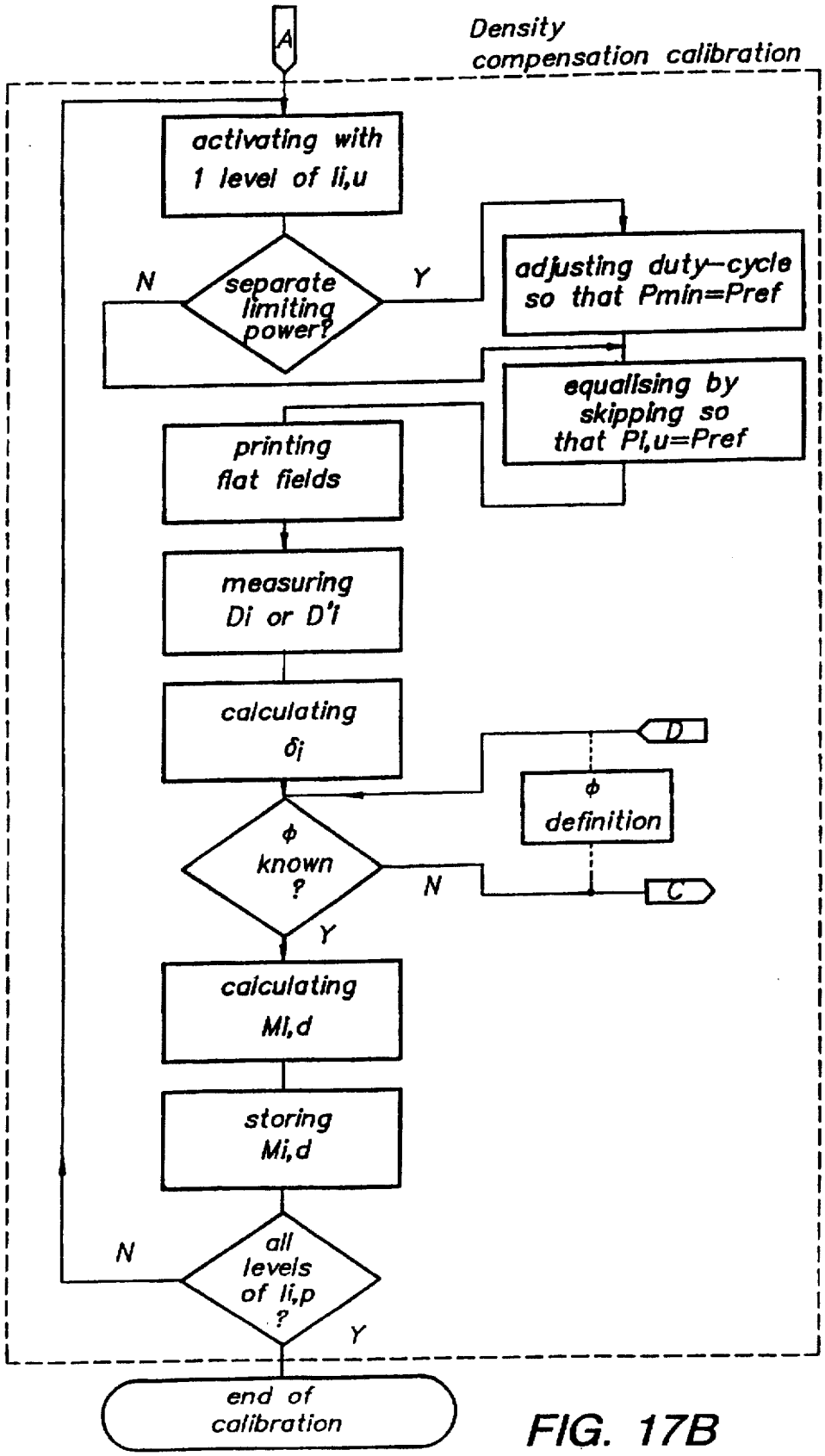
Figure 18:
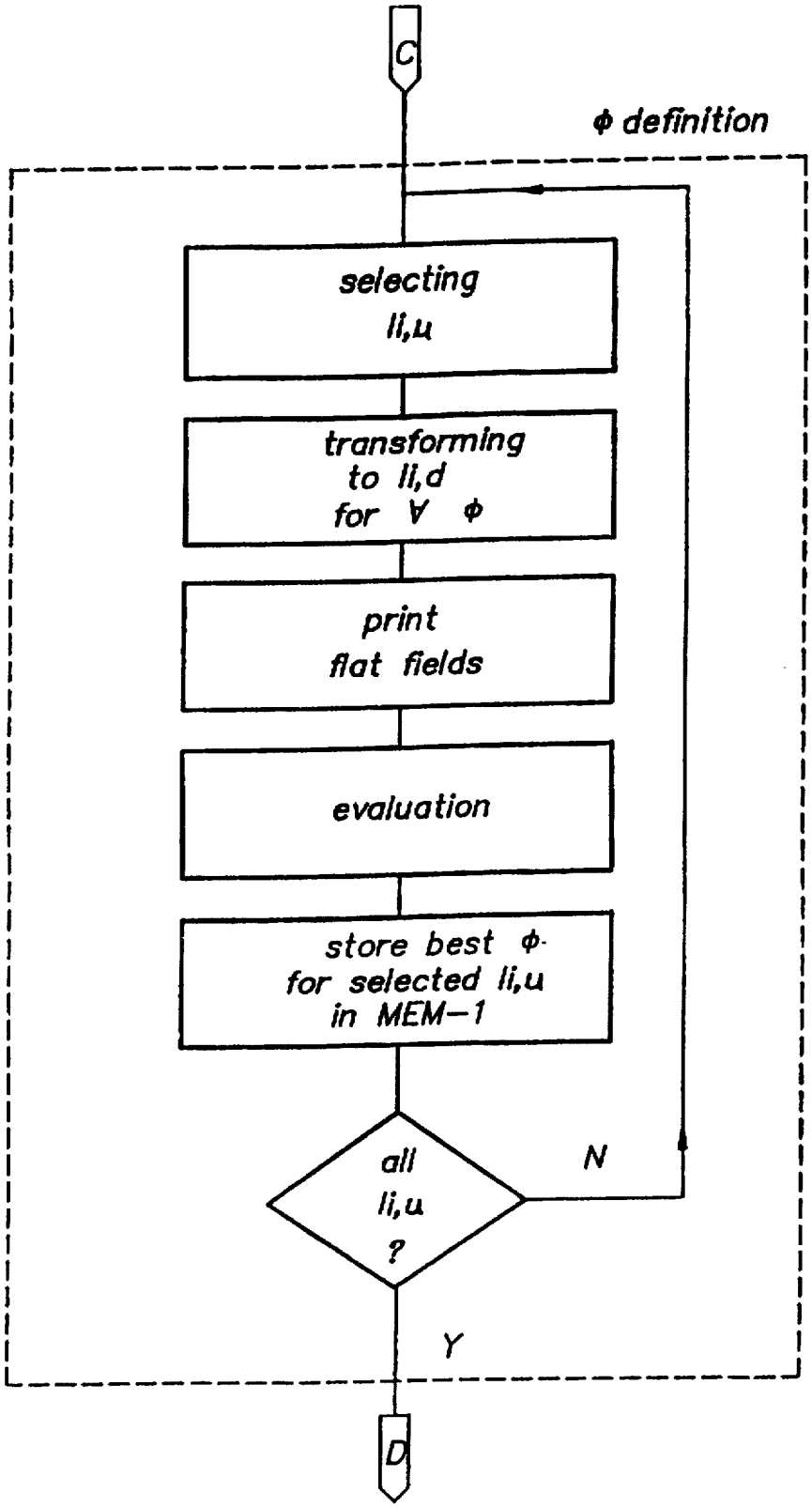
FIG. 18 is a flowchart illustrating all steps of the method for the experimental defining of the fitting parameter Φ according to a preferred embodiment of the present invention.
Figure 19A:
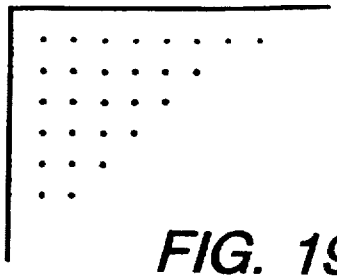
FIG. 19 illustrates preferred embodiments measuring the printing density in individual pixels.
Figure 19E:
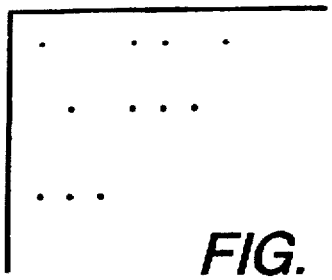
Figure 19B:
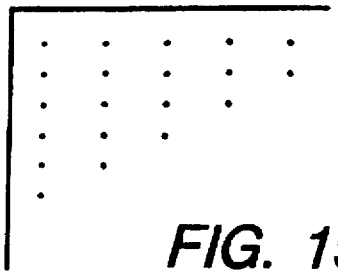
Figure 19C:
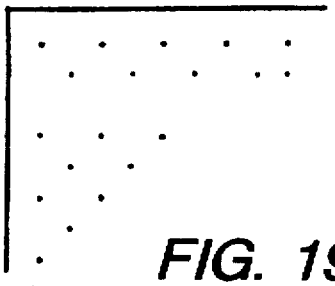
Figure 19D:
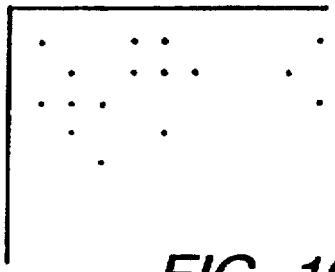
Figure 20A:
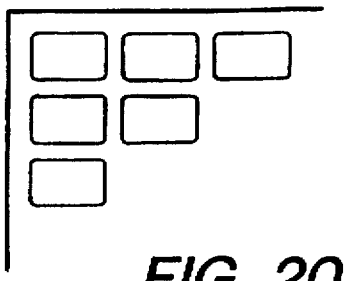
FIG. 20 illustrates preferred embodiments measuring the printing density in clustered pixels.
Figure 20B:
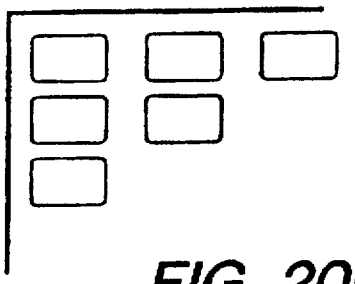
Figure 20C:
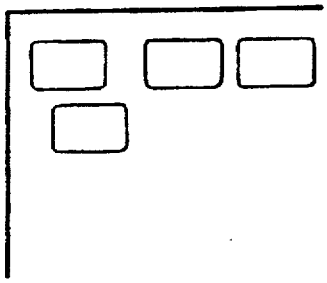
Figure 20D:
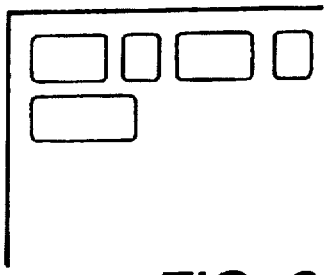
Figure 20E:
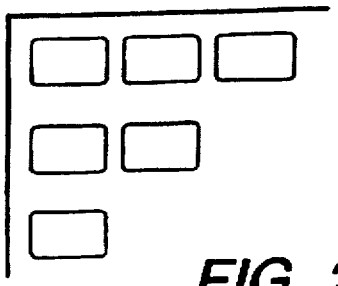
Figure 20F:
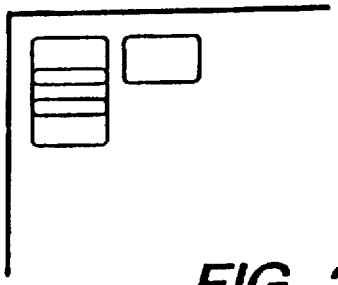
Figure 20G:
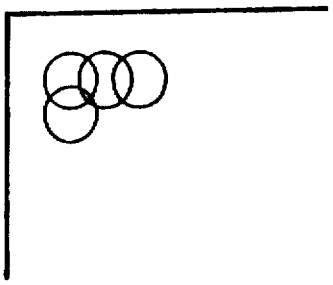

Just before starting the fully detailed description of all details of each specific step of the present invention, it might already be of great interest to make a cross reference to the FIGS. 17 and 18, which are flowcharts illustrating all steps of a preferred embodiment, according to the method of the present invention.

Figure 8:
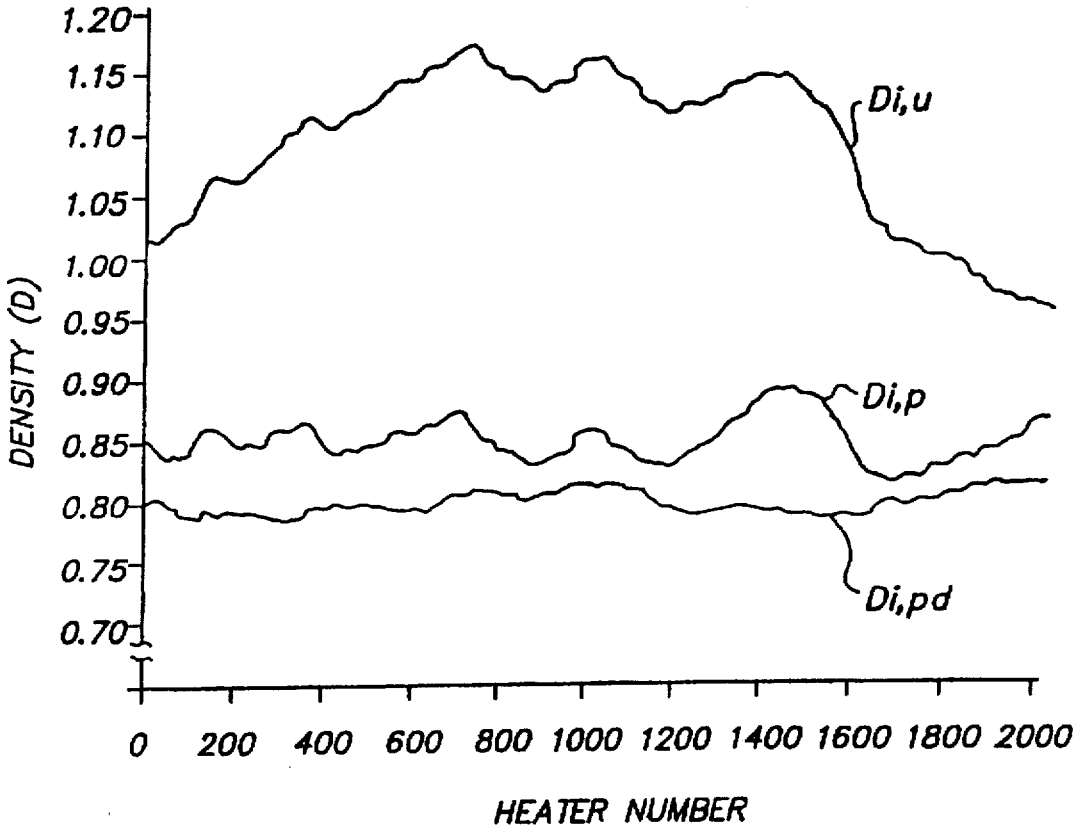
FIG. 8 is a chart illustrating the variance in printing density across a page of a flat field printed respectively with uncorrected, with power corrected and with power and density corrected input data signals.

Among all possible causes for the above mentioned banding, the most important cause of vertical banding is the existing variation in the electrical resistance values of the heating elements. Concerning said variation in the electrical resistance values, the upper part of FIG. 8 illustrates the variance in printing density ($D_i$) across a page of a flat field printed respectively with uncorrected input data $D_{i,u}$ and relates to the distribution across the thermal head of the "uncorrected" power $P_{i,u}$ available to each individual heating element $H_i$ as it may be determined during a preparatory power measurement. That's why, according to the present invention, first a correction will be made for the resistance variation. Therefor, the first step of the method consists of a power compensation calibration of the heating elements of the thermal head, which preferably can be executed according to our pending patent application (with application number 92203816.1, being filed on Sep. 12, 1992.

Before explaining said power compensation calibration in greater depth, one has to keep in mind at least the following facts. First, as the diffusion process for a pixel is a function of its temperature and of its transfertime, the printed density is a function of the applied energy. Second, according to the present invention, the activation of the heating elements is preferably executed pulsewise, which will be further described in the next paragraphs, and thus the printing density has to be related to a time averaged power. Third, before delivery of a printer to a customer, each apparatus is calibrated at the factory; herein the initial settings for which the printer is configured include a reference time averaged power available for each heating element (e.g. $P_{ref}$=65 mW).

Figure 7:
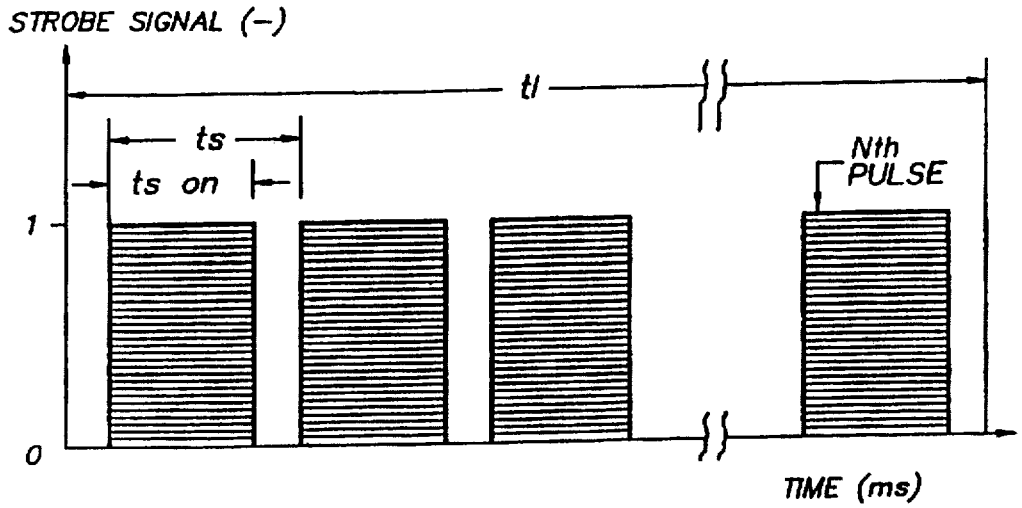
FIG. 7 is a chart illustrating principally the activating strobe pulses of a heating element with an exemplary strobe duty cycle.

Regarding the activation, in a preferred embodiment of the present invention, the activation of the heating elements is executed pulsewise in a special manner, further referred to as "duty cycled pulsing", which is indicated in FIG. 7 showing the current pulses applied to a single heating element (refs. Hi and 28 in FIG. 2). The repetition strobe period ($t_s$) consists of one heating cycle ($t_{son}$) and one cooling cycle ($t_s$–$t_{son}$) as indicated in the same FIG. 7. The strobe pulse width ($t_{son}$) is the time an enable strobe signal (ref "ANDed" STROBE in FIG. 2) is on. The strobe duty cycle of a heating element is the ratio of the pulse width ($t_{son}$) to the repetition strobe period ($t_s$). In a printer in connection with the present invention, the strobe period ($t_s$) preferably is a constant, but the pulse width ($t_{son}$) may be adjustable, according to a precise rule which will be explained later on; so the strobe duty cycle may be varied accordingly. Supposing that the maximal number of obtainable density values attains N levels, the line time ($t_l$) is divided in a number (N) of strobe pulses each with repetition strobe periods $t_s$ as indicated on FIG. 7. In the case of e.g. 1024 density values, according to a 10 bits format of the corresponding electrical image signal values, the maximal diffusion time would be reached after 1024 sequential strobe periods.

The above mentioned power compensation calibration of the heating elements, which stands for the equalizing of the power in the heating elements, may occur fully automatically at some specific time intervals (e.g. at the power up of the system, after a change of consumable, after a number of prints, etc.) and may be realised in some consecutive steps, as schematically illustrated in the upper part of the flowchart of FIG. 17, which part now will be explained shortly. (For a more extensive description of this calibration step, one may refer to the application numbered 92203816.1 and filed on Sep. 12, 1992.

The maximum time averaged power available for each heating element has to be restricted below a physical upper bound ($P_{limit}$) defined by the physical constraints of the printing system as regarding lifetime of the heating element, type of consumables to be used, melting or burning of the carrier or the receiver and loss of glossiness of the printing material. Said $P_{limit}$ may be laid down in the initial configuration settings (MEM 0) of the printing system (e.g. $P_{limit}$= 70 mW). For sake of safety, one may, instead of the real physical upper bound energy ($P_{limit}$), implement a somewhat lower power as a reference (e.g. $P_{ref}$=65 mW), also possibly laid down in the initial configuration settings (MEM 0) of the printing system, which will be used further on in the description of the present invention.

After having determined (see FIG. 17, comprising FIG. 17.1 and FIG. 17.2) in a foregoing measurement procedure the heating element actually producing the lowest time averaged power ($P_{min}$), said power $P_{min}$ may be adjusted to equal the predetermined power value $P_{ref}$ retrieved from the initial configuration settings of the printer (MEM_0). According to the present invention, this adjustment of the power preferably is executed by adjusting the pulse duration of the strobe pulses ($t_{son}$) and thus adjusting the strobe duty cycle (being $t_{son}$:$t_s$) accordingly (cf. FIG. 7). All heating elements may now be activated with a reduced, but common duty cycle and preferably such that $P_{min}$ equals the above mentioned predetermined power value $P_{ref}$, stored in a memory means of the printer (MEM_0). A very favorable method for determination of the heating element ($H_i$) actually producing the lowest time averaged power ($P_{min}$), is described in our pending patent application with application number 92203816.1, being filed on Sep. 12, 1992.

During the lifetime of the thermal head and due to its aging, the resistance values of the heating elements may change and consequently the dissipated power may change, as the applied voltage and the applied number and strobe duty cycle of the activation pulses are constants.

So, it might also be very well possible that in particular, the power dissipated by the element ($H_i$) relating to the power $P_{min}$ increases during the lifetime of the thermal head, and that eventually the new $P_{min}$ (indicated by $P'_{min}$) becomes greater than $P_{ref}$ ($P'_{min}$>$P_{ref}$).

In a next power compensation calibration, said eventually increased power of the actual reference element has nevertheless to be kept constant and equal to the predetermined power value ($P_{ref}$), which, according to the present invention, can be obtained by adjusting the pulse duration of the strobe pulses ($t_{son}$ in FIG. 7) and thus adjusting the strobe duty cycle and the time averaged power accordingly.

At this point of the present method, the maximum power available for each heating element ($P_{i,u}$) is already limited to said predetermined power value ($P_{ref}$), but said power is not yet necessarily equal for all heating elements ($H_i$), which thus leaves some banding in the printing image.

The method of the present invention prevents such uneveness by a successive step of equalising the available printing power over all heating elements to a same time averaged power value, preferably $P_{ref}$. Herefrom, it results that the really applied activation energy is made equal for all heating elements, although their individual characteristics may be different. This equalising aim may preferably be attained by ommitting an apt number of heating pulses and applies as well in duty cycled pulse systems as in non duty cycled pulse systems, as e.g. pulsewidth or pulsecount systems.

Figure 9A:
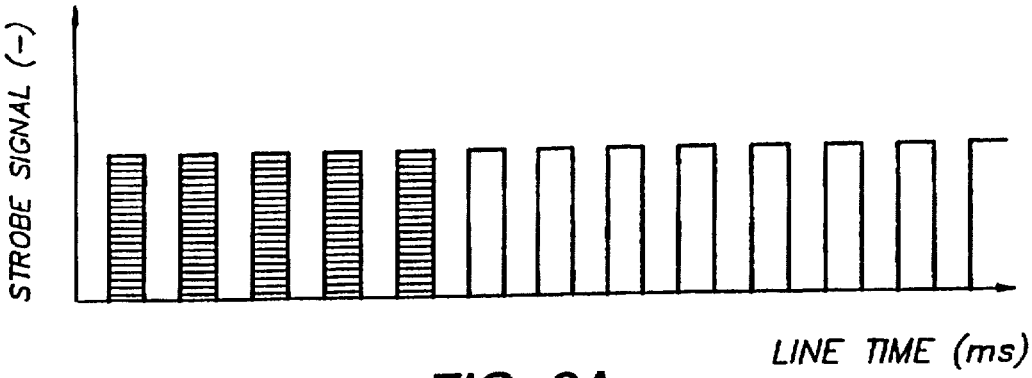
FIG. 9 is a chart illustrating principally the activating strobe pulses of a heating element with an exemplary duty cycle and with an exemplary skipping.
Figure 9B:
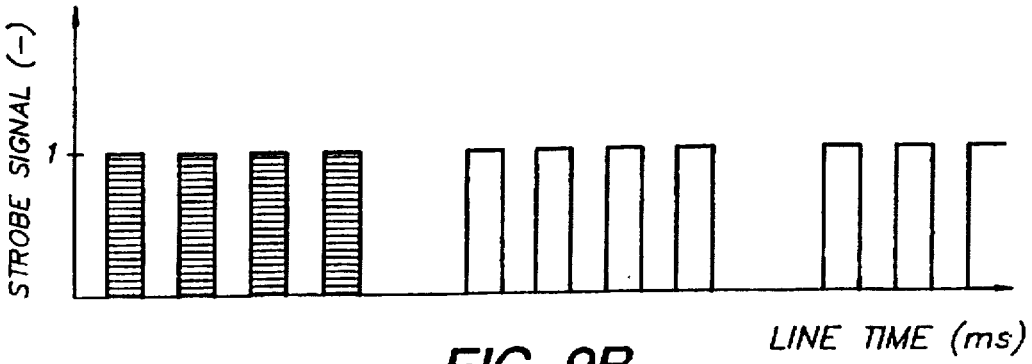

In a preferred embodiment of the present invention, with duty cycled pulse activation, and as all other heating elements but the actual reference element could dissipate more power as $P_{min}$, the further and individual reduction of the power of said other elements may preferably be done by equidistant skipping a number of heating pulses (see FIG. 9 and FIG. 17.2). By said equidistant skipping a number of heating cycles of those heating elements that generate too much instantaneous power (namely where $P_{i,u}$>$P_{min}$), the time averaged power, averaged over a time substantially less as the linetime and e.g. in the order of a number of strobe times, of all heating elements becomes equal ($P_{i,u}$=$P_{min}$) and so the temperatures of the elements do (for all values of the position index i).

In the upper part of said FIG. 9, a pulsetrain is drawn as activating the reference heating element (with $P_{min}$). In the lower part of FIG. 9, a corrected pulsetrain is drawn as activating another heating element which in the absence of the present invention, would dissipate e.g. 25 percent of power above said reference, thus dissipating 125% $P_{ref}$. As illustrated by FIG. 9, every fifth strobe pulse may be skipped. In this way, to obtain equal densities for equal image signal data $I_{i,u}$, the available time averaged power ($P_{ave}$) for every heating element may be made equal and preferably equal to the power of the heating element actually having the lowest time averaged power ($P_{min}$).

In the present invention, the wording "equidistant skipping" is meant not to be restricted in a mathematical exact relation, whereby each time precisely the same time distance or the same number of pulses between successive skippings has to occur. In general, all following skipping cases are included by the present invention: a) the case of exact equidistant skipping (e.g. successive skippings on the 4th, the 4th, the 4th . . . strobe pulse), b) the case of average equidistant skipping (e.g. successive skippings on the 4th, the 3th, the 5th . . . strobe pulse), and c) even the broader case of time spread skipping (e.g. successive skippings on the 4th, the 7th, the 16th, the 5th . . . strobe pulse). The wording "equidistant skipping" thus mainly excludes the skipping cases wherein all skipped pulses are grouped, as it is often, in the present state of the art, at the end of the line time; but other possible cases of "grouped skipping" are also excluded, as e.g. grouped skipping at the start or (nearly) in the middle of the line time.

Figure 10A:
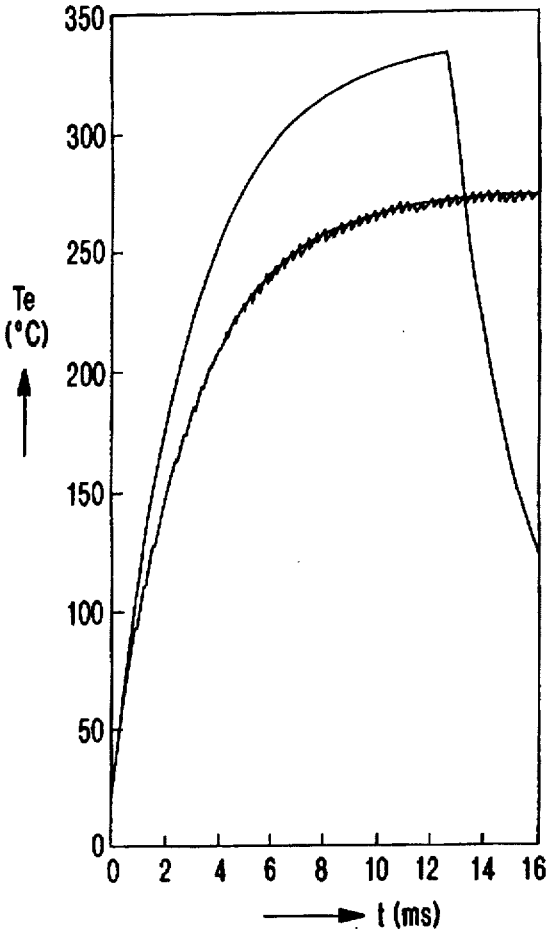
FIG. 10 is a graph of the heating and cooling curve of heating elements of 2000 Ω and of 2500 Ω, resulting from all heating pulses corresponding to one line-time including duty cycle pulsewise activation at 100% and time equidistant skipping.
Figure 10B:
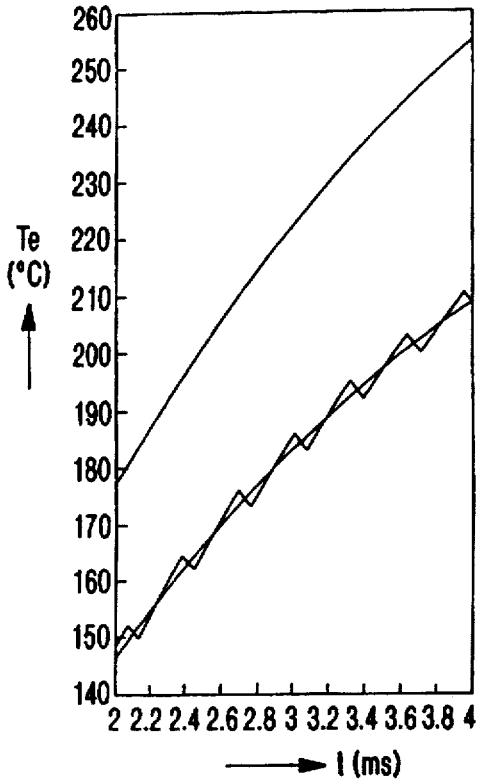
Figure 11A:
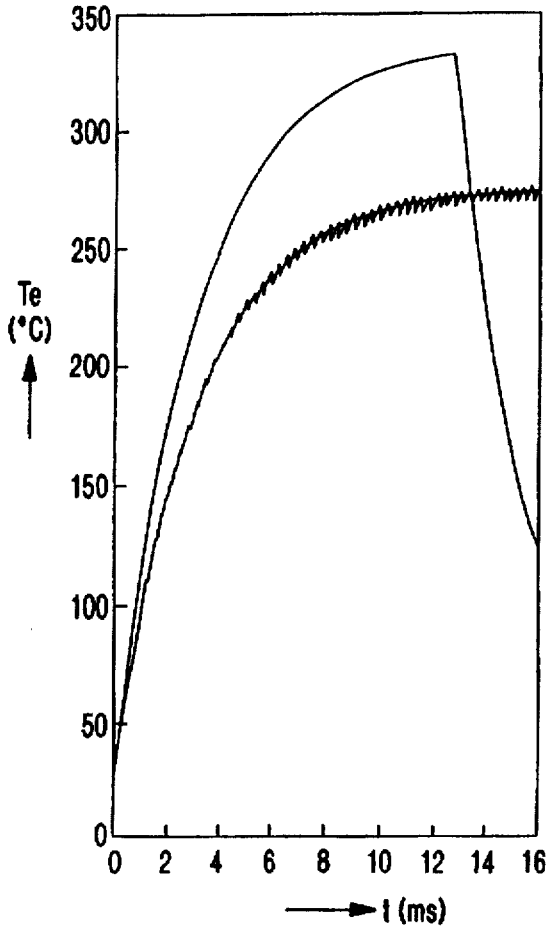
FIG. 11 is a graph of the heating and cooling curve of heating elements of 2000 Ω and of 2500 Ω, resulting from all heating pulses corresponding to one line-time including duty cycle pulsewise activation at 75% and time equidistant skipping.
Figure 11B:
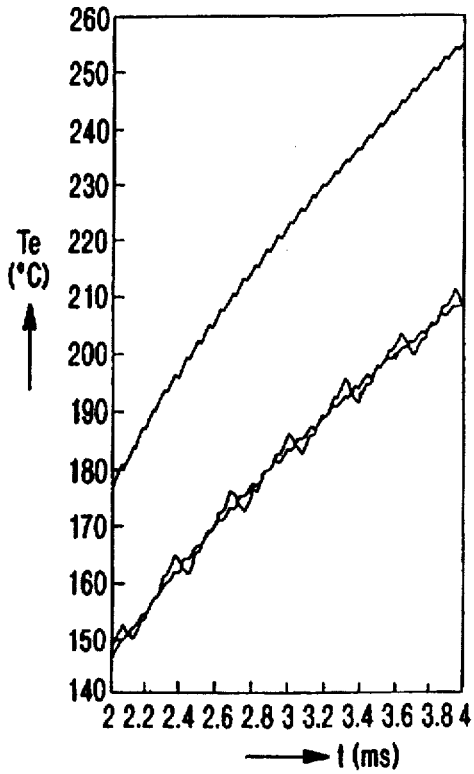

In order to make the description of the present invention as clear as possible, reference is made to FIGS. 10 and 11. Both figures, showing the temperature on the vertical axis (indicated as $T_e$ in °C.) and the time on the horizontal axis (indicated as t in ms), are graphs of the heating and cooling curves of two distinctive heating elements heated by heating pulses corresponding to one line-time and including duty cycle activation with time equidistant skipping.

Herein, FIG. 10 relates to an activation with a duty cycle of 100% and is meant as a comparative example, whereas FIG. 11 is an exemplary practical example according to the method of the present invention, with a duty cycle of 75%; all other circumstances being constant, as e.g. same time constant and same accumulated heat pro line.

The left parts of said FIGS. 10 and 11 give the temperature evolution during a complete line time of e.g. 16 milliseconds; the right parts of said FIGS. 10 and 11 give a detailed view of the temperature evolution during a small interval within said line time, e.g. from 2 to 4 milliseconds.

The upper curves represent the temperature evolution for a heating element with an electrical resistance of e.g. 2000 Ω. The lower part of said FIGS. 10 and 11 comprises two curves, wherein the smoother curve of the lower curves represents the temperature evolution for a heating element with an electrical resistance of e.g. 2500 Ω, and wherein the dented curve of the lower curves represents the temperature evolution for a heating element with an electrical resistance of e.g. 2000 Ω but now corrected by equidistant skipping in order to equalise the available power to $P_{min}$.

From said FIGS. 10 and 11, some remarkable advantages of the method disclosed by the present invention, may now be deducted very clearly.

First, the upper curve and the smoother curve of the lower curves of FIG. 10 may also be interpreted as representing the temperature evolution if a conventional breaking off LUT would be used; the dented curve of said lower curves relating to a skipping LUT being used. From this FIG. 10 it is seen very clearly that the state of the art with a conventional LUT breaks off the consecutive heating pulses at the end of a number of pulses required to reach a predetermined optical density.

Instead the method of the present invention enforces for each heating element a same "temperature profile", meaning that independent from possible variations in the individual characteristics of the distinctive heating elements, each heating element will have a same temperature rise during the heating time. Herefrom it follows that, in order to attain a same optical density, no corrections to the heating time duration are necessary. Thereabove, all heating elements remain at a same temperature with only very slight fluctuations.

Secondly, the heating power available for heating elements with different electrical resistances, e.g. from 2000 to 2500 Ω, are made equal to a same time averaged power, indicated as $P_{min}$. As a consequence, also the temperature of each heating element is at every moment nearly the same. And as a further consequence, also the density on the printed output is the same for all heating elements, which thus gives a very good eveness.

In another embodiment of the present invention, the common reduction of the strobe duty cycle may be replaced by a correspondingly enlarged individual equidistant skipping (as indicated in FIG. 17.2).

As a modification of the present method, the common reduction of the duty cycle could eventually be based on the heating element producing the highest time averaged power (indicated by $P_{max}$). In this method, first the power of the heating element producing the highest time averaged power ($P_{max}$) would be reduced to said predetermined power value ($P_{ref}$) retrieved from the initial configuration settings of the printer (MEM_0). Thereafter, the individual equalizing of the power of all the heating elements could be done by equidistant skipping an apt number of heating pulses.

Figure 13:
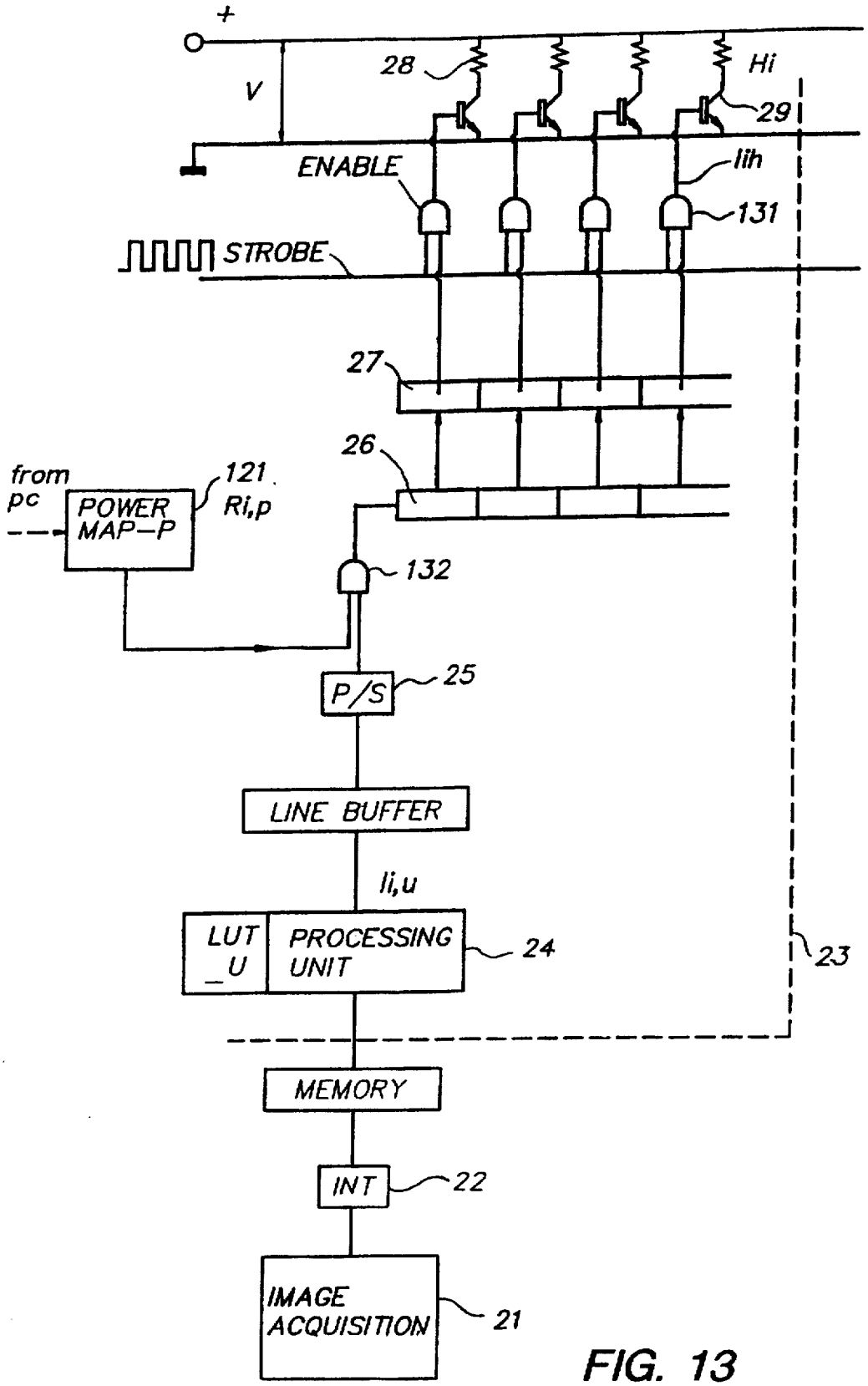
FIG. 13 is a preferred embodiment of the power compensation calibration according to the present invention and comprising a power map.

Summarizing the above mentioned preferred embodiments of the power compensation calibration method of the present invention, said calibration can be executed in one of several ways, the common data flow of which is given in FIG. 13.

A first embodiment incorporates an adjusting of the power $P_{min}$ by adjusting the duty cycle and a consequential equalising of the power $P_{i,u}$ of each heating element $H_i$ to a predetermined power value $P_{ref}$ by equidistant skipping an apt number of heating pulses.

A second embodiment, preferably relating to a power compensation calibration at maximal density, incorporates an adjusting of the power $P_{max}$ by adjusting the duty cycle and a consequential equalising of the power $P_{i,u}$ of each heating element Hi to a predetermined power value $P_{ref}$ by equidistant skipping an apt number of heating pulses. (This specific embodiment of the present invention is not indicated in FIG. 17, solely for sake of simplicity).

A third embodiment incorporates said adjusting of the power $P_{i,u}$ not by adjusting the duty cycle, but replaces said common reduction of the duty cycle by a correspondingly enlarged individual equidistant skipping, such that adjusting and equalising of the power $P_{i,u}$ of each heating element $H_i$ to a predetermined power value are obtained both together by equidistant skipping an individual apt number of heating pulses via the datapath and related to each individual heating element.

As a result of this compensation calibration step, an array of power corrections 121 may be obtained, also referred to as "power map", to obtain power corrected image signals. This array gives for each heating element ($H_i$) and for each uncorrected input data ($I_{i,u}$) the "power corrections" $R_{i,p}$ (as illustrated schematically in FIG. 17.1) intended for equidistant skipping of the strobe pulses according to the present invention. This thus guarantees an equal time averaged power available to the heating elements ($H_i$), although their individual characteristics, as resistance value (Ref. 28 in FIG. 2) and time delay in the switching circuit (Ref. 29 in FIG. 2), may be different. So, eventual heat flows between neighbouring heating elements are principally eliminated, or at least reduced significantly, which is a great advantage above the prior art of the field and is probably the cause of an improved eveness in the print image.

Such power map 121 (FIG. 12) may be implemented in the form of a lookup table, as it is in some preferred embodiments of the present invention. Herein, for each heating element a power compensation $R_{i,p}$ is memorized, comprising pro density level a row of binary 0's and 1's such that te heating element with the highest resistance and which, per consequence, could only dissipate a rather low power, is allowed to dissipate fully naturally, in order to attain the above mentioned $P_{ref}$, and hence all $R_{i,p}$'s (with i having a fixed value) equal 1. In the case of a 10 bit pixel depth, for this heating element, the power map will present a $R_{i,p}$ value consisting of 1024 times 1 (thus 111 . . . 111). For another heating element which in the absence of the present invention, would dissipate e.g. 25 percent of power above said reference, thus dissipating 125% $P_{ref}$, every fifth strobe pulse may be skipped as already illustrated by FIG. 9; and hence, in the case of a 10 bit pixel depth, the power map will present a $R_{i,p}$ value 11101110 . . . All other heating elements will have $R_{i,p}$ values in between them, as e.g. 10101010 . . . .

However, even after executing said power compensation calibration of the heating elements of the thermal head some minor density differences still may rest in the print, mostly because of further thermomechanical nonuniformities as e.g. variations in the mechanical or thermal contact between the thermal head and the back of the dye donor sheet, or variations in the thermal contact between the ceramic base of the head assembly and the heatsink, etc.

Figure 14:
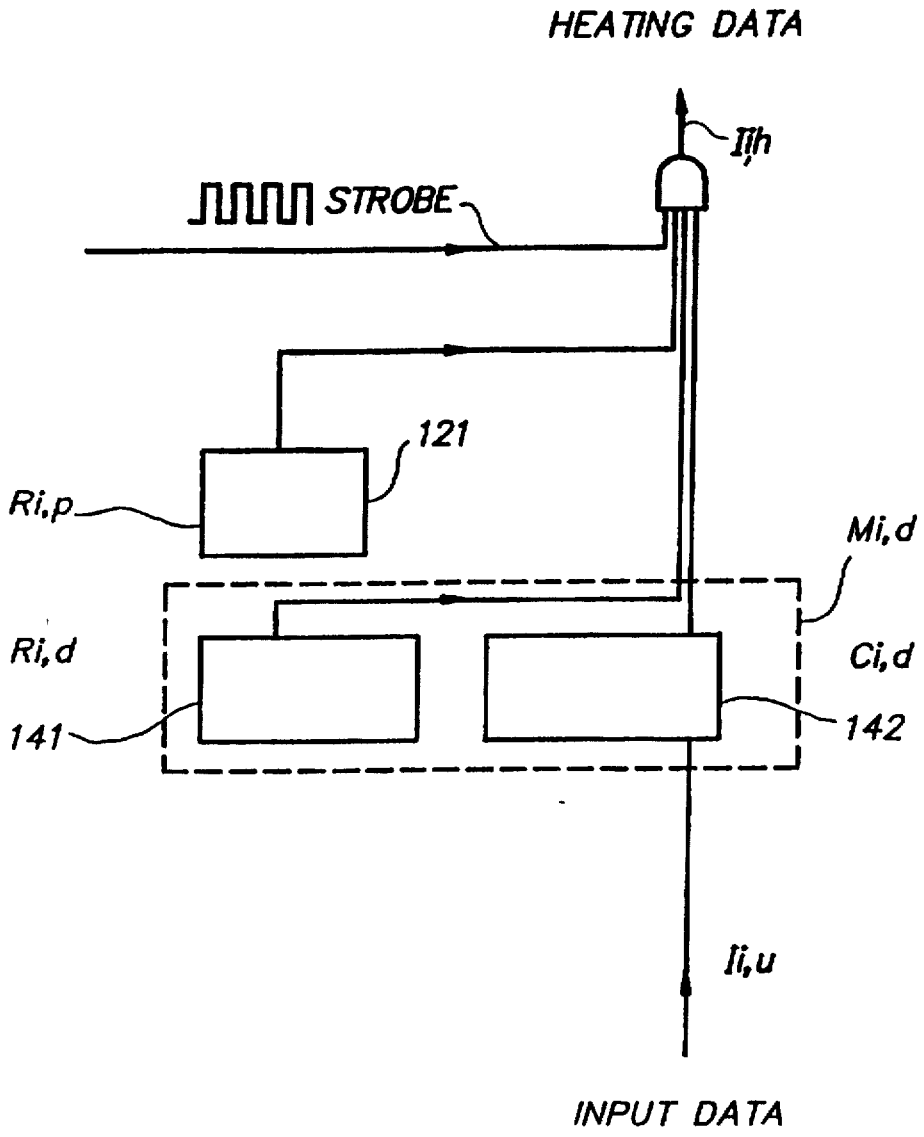
FIG. 14 is a general overview of the basic blocks of the power and density compensation calibration method according to the present invention.

As a further step in the method of the present invention, a particular "density compensation calibration" will be disclosed, of which a schematic overview is given in FIG. 14. FIG. 14 gives a general overview of the basic blocks of the present invention, which, in the further description, will be described in much more detail and in different embodiments.

In general, FIG. 14 shows a clock pulsed strobe path (indicated as STROBE), a main data path (from the uncorrected input data $I_{i,u}$ to the final input data $I_{i,h}$ supplied to the heating elements), a power map 121 resulting from the power compensation calibration, and density correction means $M_{i,d}$, comprising density correction rows $R_{i,d}$ (ref 141) or density correction factors $C_{i,d}$ (ref 142).

Keeping in mind this conceptual survey of FIG. 14, the basic blocks 141 and 142 of said compensation have to be described. In doing so and in order to be as clear as possible, first some densitometric relations have to be explained. Indeed, it is stated that, although none of the above mentioned nonuniformities can be measured directly and separately, the global result of said nonuniformities, namely the uneveness in the printed densities, can be measured rather easily using e.g. a microdensitometer. Knowing the definitions that the optical transmission (indicated by the symbol T) of a print is the ratio of the light intensity of the transmitted light through the print to the light intensity of the incident light, and that the optical density (indicated by the symbol D) equals the logarithm to the base 10 of the reciprocal of the transmission, following formula may be defined for every pixel, wherein the index i still denotes the individual position across the head:

$$D_i=\log(1/T_i)=-\log(T_i) \quad [1a]$$

which may be adapted to correct for the minimum transmission ($T_{min}$) of the receiver material to formula $$D_i'=\log(T_{min}/T_i) \quad [1b]$$

From these density values ($D_i$ or $D'_i$), the input data ($I_i$) for each heating element ($H_i$), representing the number of strobe pulses ($N_i$) to be applied, can be corrected in order to improve the eveness by the method described in the next paragraphs.

After the already extensively described preparatory step of power compensation calibrating the heating elements of the thermal head, the next step in the density compensation calibration makes a flat field on a receiver, preferably a transparent receiver. This is accomplished by providing each of the heating elements ($H_i$) in the thermal head with a power corrected number of strobe pulses from a head driving circuit. The power corrected number can be obtained by the method described above. If said flat field comprises at least a heigth, e.g. 50 mm, which can be measured correctly by a transmission or reflection densitometer or microdensitometer, the transmittance or a relative transmittance of the transparent receiver versus the position across the head direction may be measured by said densitometer or microdensitometer.

A microdensitometer may be used advantageously if the measuring of the printing density in a flat field print is carried out on individual pixels. A conventional densitometer may be used advantageously if the measuring of the printing density in a flat field print is carried out on socalled "clustered" pixels, which are pixels aggregated or clinged together. For sake of simplicity, the following description will be mainly worded in relation to individual pixels; but later on, also several preferred embodiments specifically directed towards clustered pixels will be described in detail (with reference to the later FIG. 20).

The output from the microdensitometer is a plurality of transmittance data, from which a set of density values may be calculated, according to formula [1a] or [1b]. This set of density values, further simply indicated by $D_i$ solely but also implicitely including if relevant the meaning of $D'_i$, corresponds to each individual heating element. From said set of density values, a correction may be made to the applied energy to each heating element in order to improve the eveness.

After the measuring in said flat field print of the printing density ($D_{i,p}$) for each pixel corresponding to a heating element, the deviation ($\delta_i$) of the printing density in relation to a printing density intensionally aimed at by the power applied to each heating element may now be calculated for each heating element in one of following ways.

Generally, the above mentioned determining for each heating element of the deviation in printing density ($\delta_i$) may be represented by the difference to a desired density, or calculated relative to $D_{min,p}$ and/or to $D_{max,p}$ or calculated relative to the ratio $(D_{i,p}-D_{min,p})/(D_{max,p}-D_{min,p})$. Herein $D_{i,p}$ is the individual pixel related optical density realised by activating the heating elements with power compensated input data $I_{i,p}$, whereas $D_{min,p}$ is the minimum of all $D_{i,p}$ on a printline, and $D_{max,p}$ is the maximum of all $D_{i,p}$ on same said printline.

In a preferred embodiment the variation in printed density ($\delta_i$) may be calculated from a single set of density measurements on one line of a flat field print. In another preferred embodiment, several lines may be measured on at least one printed flat field and the average values of the densities are calculated, which gives a higher statistical reliability. In still another preferred embodiment, several lines on at least one printed flat field may be measured and the median values of the densities are calculated, which results in statistical more robust results, thus being less influencable by possible outliers, as possibly originating from dust or scrathes. Some further preferred embodiments with measuring of the density over more tan one line are illustrated in FIG. 20, to be described later on.

Now that some densitometric relations are recapitulated, the description of the density compensation step of the present invention (ref. FIG. 14) can be continued, thereby disclosing the "black boxes" 141 and 142.

In said density compensation calibration according to the present invention, the above-mentioned density measurements and correction calculations may be used to correct for remaining uneveness in the printing density. For a person skilled in the art, said practical use can be carried out in several ways, two of which are described hereinafter.

In common to both said embodiments of the present invention, said correction of the applied energy is made in reference to the number and the time spread of the strobe pulses, e.g. by additional skipping an apt number of pulses; said skipping being preferably distributed over the total number of strobe pulses (which principe was already explained above in reference to FIG. 9).

Figure 12:
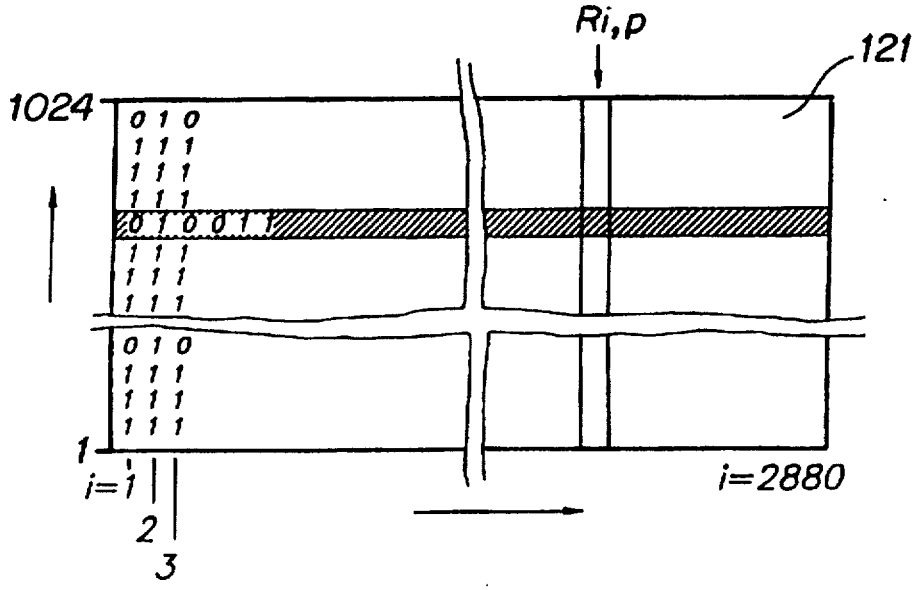
FIG. 12 is an array of power corrections $R_{i,p}$ according to the present invention intended for equidistant skipping of the strobe pulses and also referred to as "power map"
Figure 15:
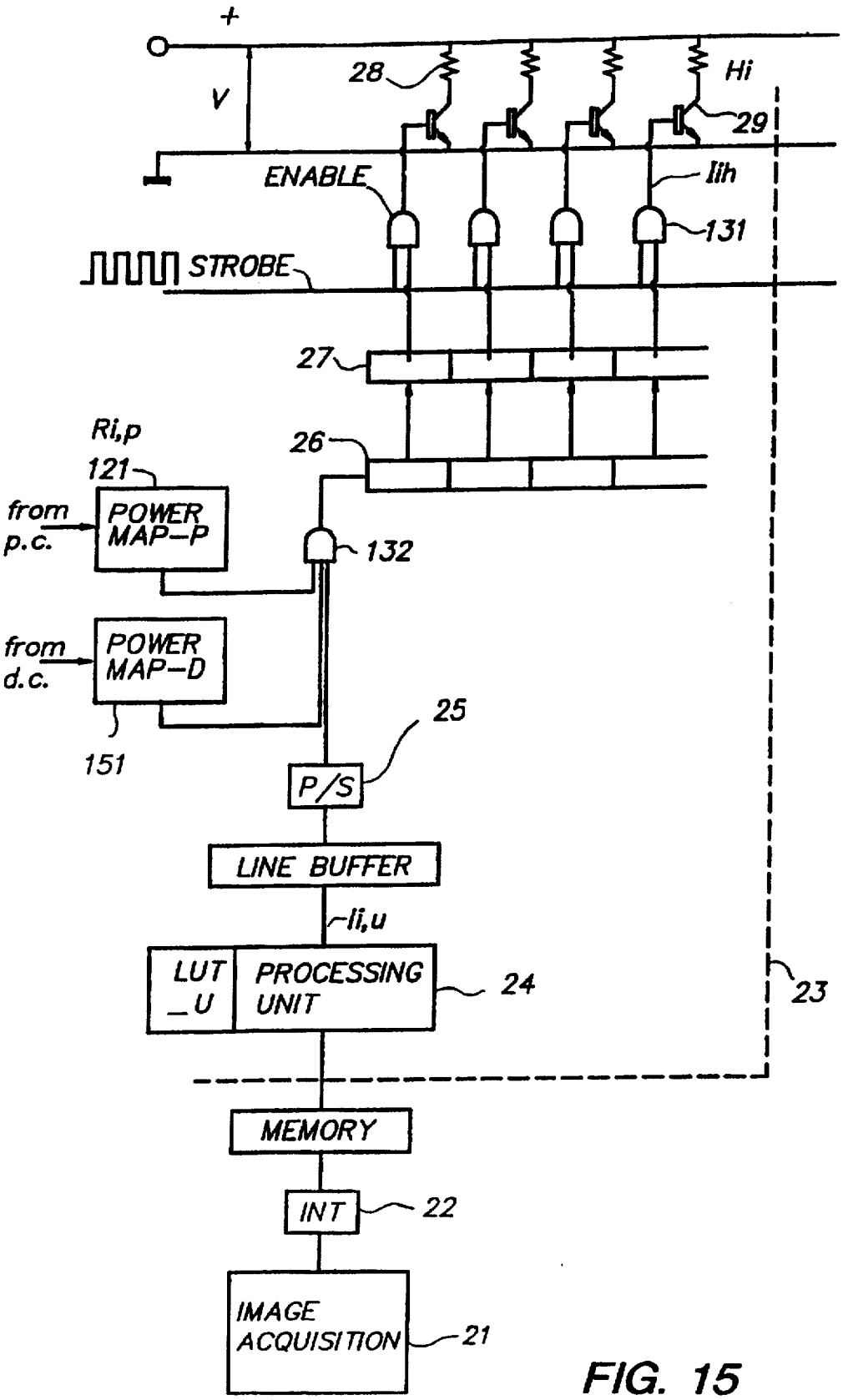
FIG. 15 is a first preferred embodiment of the power and density compensation calibration method according to the present invention.

In a first embodiment of the present invention (FIG. 15), the density deviation factor $\delta_i$ may adapt the contents of the abovementioned power map 121 (FIG. 12 & FIG. 13). More practically, from said $\delta_i$ may result pro heating element $H_i$ a row vector consisting of logical 0's and 1's, as e.g. [11111111001111101 . . . ], called "density correction row" $R_{i,d}$. It is stated that this correction row $R_{i,d}$ not necessarily has to be time equidistant, as it may be illustrated by a power map 121 intended for maximal 1024 density levels relating to a heating element with index i and to a density level d. If, for example, the original contents of said power map 121, after the power compensation calibration step, was e.g. skipping every 50th data pulse, now e.g. every 49th or every 51th data pulse may be skipped, precisely to attain a good eveness in printing density. According to this embodiment of the present invention, after the already described calculation of $\delta_i$, further steps include calculating for each heating element a density correction row $R_{i,d}$ taking into account said deviation ($\delta_i$) in printing density, and storing each of said density correction rows $R_{i,d}$ individually to each heating element ($H_i$) into a memory means (POWER MAP_D, ref. 151).

For a person skilled in the art, it is obvious that said power maps POWER MAP_P and POWER MAP_D (refs 121 and 151) eventually may be combined into one single power map.

Figure 16:
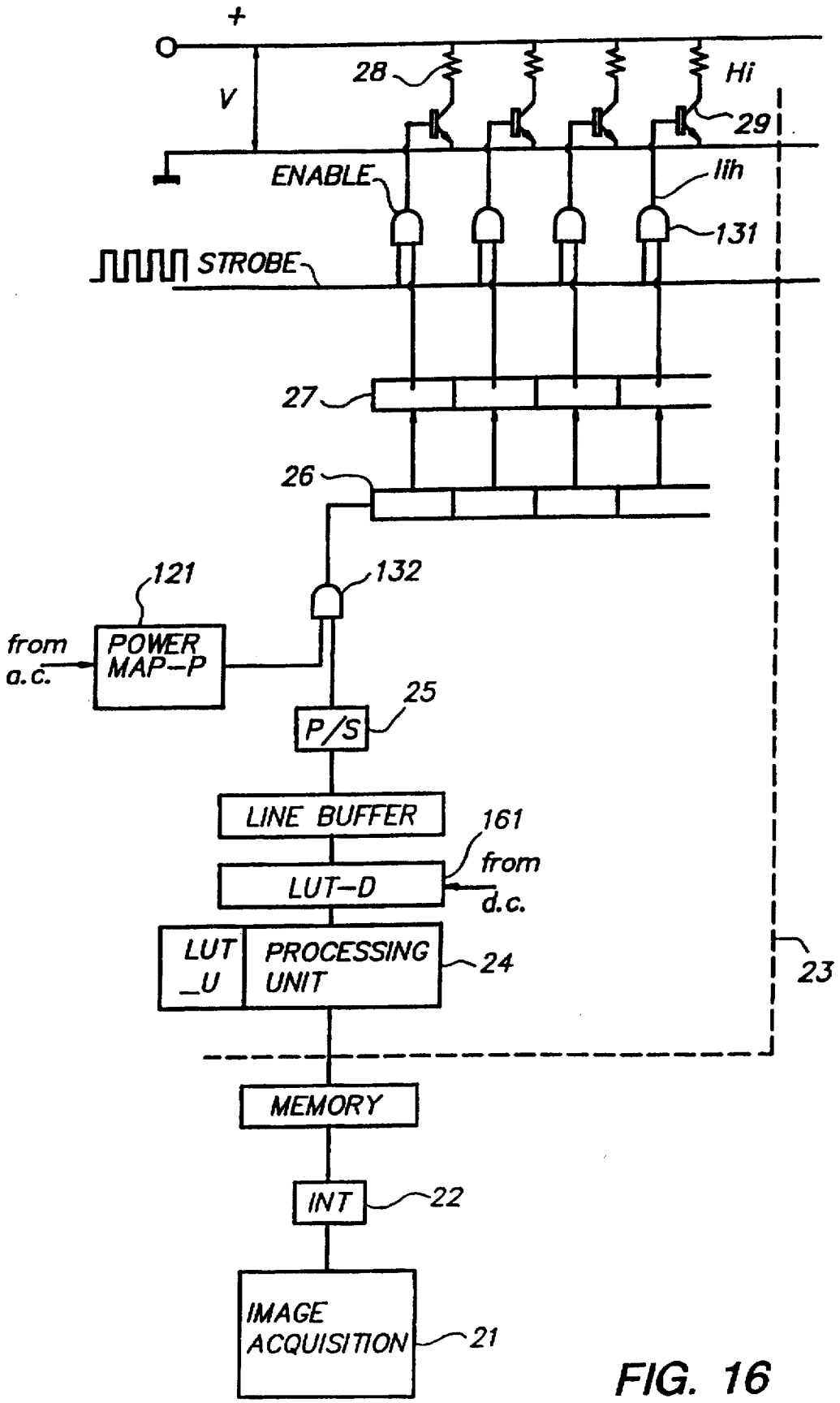
FIG. 16 is a second preferred embodiment of the power and density compensation calibration method according to the present invention.

In a second preferred embodiment (FIG. 16), after the already described calculation of $\delta_i$, further steps may include transforming the input data ($I_{i,u}$) to each heating element taking into account said deviation ($\delta_i$) in printing density, the thus transformed data further being indicated as "density-corrected input data" $I_{i,d}$ and storing each of said density corrected input data ($I_{i,d}$) individually to each heating element ($H_i$) into a memory means (LUT_D, ref 161). In this embodiment, the density corrected input data $I_{i,d}$ may be obtained preferably according to the next formula $$I_{i,d}=\Phi\times I_{i,u}+(1-\Phi)\times I_{i,u}\times(\delta_i) \quad [2a]$$

or more specifically according to the formula $$I_{i,d}=\Phi\times I_{i,u}+(1-\Phi)\times I_{i,u}\times[(D_{i,p}-D_{min,p})/(D_{max,p}-D_{min,p})] \quad [2b]$$

wherein $\Phi$ is a socalled "fitting parameter" which has to be defined empirically and preferably lies between 0.75 and 0.98.

A more general representation of formulae [2a] and [2b] is given by formula [2c] and introduces a "density correction factor" $C_{i,d}$ $$I_{i,d}=C_{i,d}\times I_{i,u} \quad [2c]$$

For a person skilled in the art, it is obvious that instead of said storing each of said density corrected input data ($I_{i,d}$), also said "density correction factor" $C_{i,d}$ may be stored.

The storing into a memory means of whether each of said transformed input data ($I_{i,d}$) or of each of said density correction factors (Ci,d), both individually related to each heating element, can preferably be implemented in the form of a look up table (indicated as LUT_D, ref 161).

The use of a specific LUT embodiment brings an additional advantage. While such a table consists of an ordered pair of input and output values, the LUT is very efficient in performing repetitive operations. Indeed, rather than calculating every time the density corrected input data $I_{i,d}$ from the power compensated input data $I_{i,p}$, these power and density corrected data $I_{i,d}$ are directly retrieved from said LUT. Especially when dealing with large size images, this can save a significant amount of time.

As a result of the just described density compensation calibration step, each heating element is activated by power and density corrected signals available at the output of the ENABLE AND gate 131 (see FIGS. 15 and 16), which thus guarantees an equal density printed by the heating elements 29, although their individual characteristics, as e.g. resistance value and mechanical or thermal contacts, may be different.

Said fitting parameter $\Phi$ is generally not a constant over the entire density range.

In a preferred embodiment of the present invention, said fitting parameter $\Phi$ may be defined (see FIG. 18) empirically by the following method:

for a number, e.g. 4, of $I_{i,p}$ (e.g. $I_{i,p}$=600) a number of transformations according to formula [2a or 2b] are calculated for distinctive values of $\Phi$ (e.g. $\Phi$ between 0.75 and 0.98);

for each transformation, at least one flat field image is printed with the type of consumables as they will be used in reality;

these testprints are observed and evaluated by several and independent technicians which evaluation ends in the selection of the prints with the best eveness;

the $\Phi$ values corresponding to the flat field prints selected as having the best eveness may retrievably be stored in a memory means (indicated as MEM_1 in FIG. 18).

In summary, in FIG. 17 there is illustrated a principal flow chart of all main steps of the method of the present invention according to a preferred embodiment, including as well the power compensation calibration (see FIG. 17.1) as the density compensation calibration (see FIG. 17.2). And in FIG. 18 there is illustrated a principal flow chart of all steps of the method for the experimental defining of the fitting parameter ($\Phi$) according to a preferred embodiment of the present invention. Because the arrangements of FIG. 17 and of FIG. 18 are similar in structure and operation to the above identified steps in the full description, they do not need to be described once again. As already mentioned above, some of these steps may be modified or even omitted, within the same scope of the present invention.

Once the density corrected values $I_{i,d}$ or the density correction factors $C_{i,d}$ or the density correction rows $R_{i,d}$ are stored in a memory means, the printing system is ready to perform the steps of correcting an input image. While printing, said correction may be carried out by replacing each initially uncorrected input data signal ($I_{i,u}$) by its power and density corrected input data signal ($I_{i,d}$). Thus, according to the present invention, also obtained is a method for correcting across-the-head uneveness in the printing density ($D_i$) of a thermal sublimation printer containing a head having a plurality of heating elements ($H_i$) and containing storing means for holding density corrected values $I_{i,d}$ or density correction factors $C_{i,d}$ or density correction row $R_{i,d}$ for each heating element $I_{i,d}$ so that while printing said density corrected values $I_{i,d}$ or said density correction factors $C_{i,d}$ or said density correction row $R_{i,d}$ can be used to print input image data, characterized in that said density corrected values $I_{i,d}$ or said density correction factors $C_{i,d}$ or said density correction row $R_{i,d}$ are obtained according to the method described hereabove.

As a survey of the remarkable results of the present invention, FIG. 8 illustrates the variance in printing density ($D_i$) across a page of a flat field printed respectively with uncorrected input data $D_{i,u}$, with power corrected input data $D_{i,p}$ and with power and density corrected input data $D_{i,pd}$. The illustrated curves may progressively be obtained by the consecutive steps of the present invention, which steps were hereabove described one by one. Note that for the density corrected values the same densities are achieved for many more heating elements than for uncorrected values of input data.

Although the invention has been described with respect to preferred embodiments, it is not to be so limited, as changes and modifications can be made within the intended scope of the present invention defined by the appended claims.

The correcting method of the present invention can be carried out either as an integrated part of the power correction or as a separate and consecutive input data transformation.

It is clear that while measuring the density ($D_i$) and determining the variance ($\delta_1$) in accordance with the present invention, at the same occasion one could detect if said density and/or said variance becomes out of range, in which case an error indication could be displayed to the customer.

The power and density correction of the present invention may occur at the power up of the system, after a change of consumable, after a number (e.g. 1000) of prints, etc.

Summarizing the presently disclosed method for printing an image by thermal sublimation, some steps can be executed in one of several preferred embodiments, the main characteristics of which are given hereinbelow. In doing so, reference is made to FIG. 19 which illustrates preferred embodiments measuring the printing density in individual pixels; and to FIG. 20 which illustrates preferred embodiments measuring the printing density in clustered pixels.

In a first embodiment of the present invention, the method for printing an image by thermal sublimation is characterized in that the pixels wherefrom the printing density in a flat field print is measured, correspond to individual pixels. Such embodiment is schematically illustrated in FIGS. 19.1 to 19.5.

In one embodiment of the present invention, the method for printing an image by thermal sublimation is characterized in that the initial pixel on a line wherefrom the printing density in a flat field print is measured, is located either in a fixed position (see FIGS. 19.1 and 19.2), or in a (phase-) shifted position (see FIGS. 19.3 to 19.5)

In a further embodiment of the present invention, the method for printing an image by thermal sublimation is characterized in that the pixels wherefrom the printing density in a flat field print is measured, correspond to individual pixels which are distant pixels, either periodically distant (see FIGS. 19.1 and 19.2) or variably distant (see FIGS. 19.3 to 19.5).

It may be clear that in case all individual pixels are measured, the highest accuracy may result. It also follows that in case distant pixels are measured, the capacity of the memory may be reduced economically; and that in case of variably distant pixels, possible sytematic faults also may be reduced.

In any embodiment of the present invention which does not measure the realized density corresponding to each individual pixel, the estimating for each heating element of the individual deviation ($\delta_i$) of the printing density from a printing density aimed at by said power applied to each heating element ($H_i$) may preferably be carried out by curve fitting. As this technique is well known to the people skilled in the art, it does not require any additional description.

In a further embodiment of the present invention, the method for printing an image by thermal sublimation is characterized in that the distant pixels wherefrom the printing density in a flat field print is measured are variably distant in one direction, e.g. in either horizontal direction (see FIG. 19.4) either in vertical direction (see FIG. 19.3), or are variably distant in two perpendicular directions, preferably in horizontal and in vertical direction (see FIG. 19.5).

In a still further embodiment of the present invention, the method is characterized in that the pixels wherefrom the printing density in a flat field print is measured, correspond to clustered pixels comprising individual pixels aggregated or clinged together (see FIG. 20), having either a fixed number (see FIGS. 20.1 to 20.3, 20.5 to 20.7) of pixels or a variable number (see FIG. 20.4) of pixels.

It may be clear that in case of clustered pixels, a more conventional densitometer e.g. with a conventional circular spot of a diameter 3 to 5 mm may be used and that the capacity of the memory may be reduced economically. It also may be clear that in case all individual pixels are measured, the highest accuracy may result. It also follows that in case distant clusters are measured, the capacity of the memory further may be reduced even more economically; and that in case of variably distant clusters, possible sytematic faults also may be reduced.

In a still further embodiment of the present invention, the method is characterized in that the clustered pixels are aggregated into a rectangular or a quasi-rectangular spot (see FIGS. 20.1 to 20.6) or into a circular spot (see FIG. 20.7).

In a next embodiment of the present invention, the method for printing an image by thermal sublimation is characterized in that the initial cluster on a line wherefrom the printing density in a flat field print is measured, is located either in a fixed position (see FIGS. 20.1 and 20.2; 20.4 to 20.7), either in a (phase) shifted position (see FIG. 20.3)

In a still further embodiment of the present invention, the method is characterized in that consecutive sets of clustered pixels are distant, either periodically distant (see FIGS. 20.1 and 20.2, 20.4 or 20.5) or variably distant (see FIGS. 20.3 and 20.6).

In a still further embodiment of the present invention, the consecutive sets of clustered pixels are variably distant in one direction, e.g. in horizontal direction (see FIG. 20.3) or in vertical direction, or are variably distant in two perpendicular directions, preferably in horizontal and in vertical direction.

In a still further embodiment of the present invention, the method is characterized in that consecutive sets of clustered pixels are partly overlapping (see FIGS. 20.6 and 20.7).

In a still further embodiment of the present invention, the method for printing an image by thermal sublimation is characterized in that a memory means (MEM_C) for holding a density correction means $M_{i,d}$ comprises a floppy disk drive fitted for cooperating with a floppy disk for holding a density correction means $M_{i,d}$ for each heating element $H_i$ to be used to correct the input image data while printing.

In a still further embodiment of the present invention, the method for printing an image by thermal sublimation is characterized by the step of storing the estimates for each heating element of the deviation ($\delta_i$) of the printing density ($D_{i,p}$) from a printing density $D_{i,t}$ aimed at by said power applied to each heating element in a memory means that comprises a floppy disk.

In a still further embodiment of the present invention, the method for printing an image by thermal sublimation is characterised by the step of storing the values (e.g. 2000 Ω, 2500 Ω) of the electrical resistances of the (e.g. 2880) different heating elements in a memory means that comprises a floppy disk.

Both last mentioned embodiments have the specific advantage that, if the thermal head is accurately measured while leaving the manufacturing, it may be accompanied with a floppy disk holding only a moderate number of measured values (e.g. 2880). At the first starting up of the printer installed at an end-user, this floppy disk has to be introduced in a floppy disk drive of the printer, and preferably copied on a hard disk of the printer. Thereafter, at every starting up of the installed printer, said moderate number of measured values (e.g. 2880) may be read on the hard disk of the printer and may be followed by an automatically generating of the density correction means $M_{i,d}$ described hereabove.

As the method of the present invention provides a remarkable eveness in the printing density across the headwidth, said method is very well suited to be used in medical diagnosis. Further, the printing may be applied in graphic representations, in facsimile transmission of documents etc.

This invention may be used as well for greyscale thermal sublimation printing as well as for colour thermal sublimation printing.

We claim:

1. Method for correcting across-the-head uneveness in a thermal printing system, comprising the steps of:

1) supplying a stream of uncorrected input data $I_{i,u}$ to a processing unit of a thermal printer having a line type thermal head with a plurality of heating elements $H_i$ each having a determined value of electrical resistance;

2) obtaining density correction means $M_{i,d}$ for improving across-the-head uneveness in printing density according to the following steps:

a) duty cycled pulsewise activating each heating element with image input data, further indicated as "power compensated input data" $I_{i,p}$ so that a same time-averaged power is generated in each heating element irrespective of individual differences in electrical characteristics of heating elements to obtain a flat field print; comprising the substeps of:

(i) retrieving, from a memory MEM_0 in the printer, a predetermined power value;

(ii) adjusting the power available for each heating element to said predetermined power value by commonly adjusting a strobe duty cycle to all heating elements so that the available printing power of each heating element does not surpass the power that can be dissipated in the heating element with the highest value of resistance of all heating elements;

(iii) equalizing the available printing power of each heating element by equidistant skipping to each heating element an individual number of strobe pulses;

b) measuring in said flat field print printing densities ($D_{i,p}$) of pixels (or "picture elements") corresponding to heating elements;

c) estimating the individual differences in non-electrical characteristics of the heating elements by estimating for each heating element a deviation ($\delta_i$) of the printing density from a desired printing density produced by said power applied to each heating element;

d) calculating for each heating element a density correction means $M_{i,d}$ taking into account said deviation ($\delta_i$) in printing density; and e) storing each of said density correction means $M_{i,d}$ individually to each heating element into a memory (MEM_C);

3) combining for each individual heating element the respective uncorrected input data $I_{i,u}$ with the respective density correction means $M_{i,d}$; and, 4) providing the thus corrected data $I_{i,c}$ to the thermal head for reproducing the image.

2. A method according to claim 1, wherein the step of measuring said pixels further comprises the step of measuring pixels that correspond to individual heating elements.

3. A method according to claim 1, wherein the step of measuring said pixels further comprises the step of measuring clustered pixels, comprising pixels aggregated or clung together, having either a fixed number of pixels or a variable number of pixels.

4. A method according to claim 3, wherein the step of measuring the clustered pixels further comprises the step of measuring pixels that form a rectangular, a quasi-rectangular or a circular cluster of pixels.

5. A method according to claim 3, wherein the step of measuring said pixels further comprises the step of measuring consecutive sets of clustered pixels that are partly overlapping.

6. A method according to claim 3 wherein said step of estimating for each heating element the deviation ($\delta_i$) of the printing density from a desired printing density produced by said power applied to each heating element ($H_1$) is carried out by curve fitting.

7. A method according to claim 1, wherein the step of calculating said density correction means $M_{i,d}$ further comprises the step of providing said density correction means $M_{i,d}$ as a density correction row $R_{i,d}$ and providing said MEM_C as a power map.

8. A method according to claim 1, wherein the step of calculating said density correction means $M_{i,d}$ further comprises the step of providing said density correction means $M_{i,d}$ as a density correction factor $C_{i,d}$ and providing said MEM_C as a lookup table.

9. A method according to claim 1 wherein the step of storing each of said density correction means $M_{i,d}$ individually to each heating element into said memory MEM_C, further comprises the step of providing a floppy disk drive fitted for cooperating with a floppy disk for holding said density correction means $M_{i,d}$ for each heating element to be used to correct the input data while printing.

10. A method according to claim 1, further comprising the step of storing in a memory that comprises a floppy disk, the estimates for each heating element of the deviation ($\delta_i$) of the printing density from the desired printing density produced by said power applied to each heating element.

11. A method according to claim 1, further comprising the step of storing in a memory that comprises a floppy disk, the values of the electrical resistance of the different heating elements.

12. A method according to claim 8, further comprises the step of calculating said density correction factor $C_{i,d}$ for transforming the input data $I_{i,u}$ to each heating element, according to the formula $$I_{i,d}=C_{i,d}\times I_{i,u}$$

or according to the formula $$I_{i,d}=\Phi\times I_{i,u}+(1-\Phi)\times I_{i,u}\times(\delta_i)$$

or according to the formula $$I_{i,d}=\Phi\times I_{i,u}+(1-\Phi)\times I_{i,u}\times[(D_{i,p}-D_{min,p})/(D_{max,p}-D_{min,p})]$$

wherein $\Phi$ is a fitting parameter.

13. A method according to claim 2 or 3, wherein the step of measuring an initial pixel or an initial cluster on a line further comprises the step of measuring the initial pixel or the initial cluster on a line that is located either in a fixed position, or a shifted position.

14. A method according to claim 2 or 3, wherein the step of measuring further comprises the step of measuring distant pixels which are either periodically distant or variably distant or to clustered pixels which are either periodically distant or variably distant.

15. A method according to claim 7 or 8, wherein said step of estimating includes calculating for each heating element the deviation ($\delta_i$) in printing density (D) represented by the difference from a desired density, or calculated relative to $D_{min}$ and/or $D_{max}$ or calculated relative to a ratio $(D_{i,p}-D_{min,p})/(D_{max}-D_{min,p})$.

16. A method according to claim 14, wherein the step of measuring the distant pixels or the distant clusters further comprises the step of measuring the distant pixels or the distant clusters that are distant in one direction, or are distant in two perpendicular directions.

17. A method according to claim 14 wherein said estimating for each heating element the deviation ($\delta_i$) of the printing density from a printing density aimed at by said power applied to each heating element ($H_i$) is carried out by curve fitting.

18. A method according to claim 14 wherein said step of estimating for each heating element the deviation ($\delta_i$) of the printing density from a desired printing density produced by said power applied to each heating element ($H_i$) is carried out by curve fitting.

* * * * *